US011280080B2

(12) United States Patent
Bucklitsch

(10) Patent No.: US 11,280,080 B2
(45) Date of Patent: Mar. 22, 2022

(54) KIT FOR DEFINING A RECESS FOR A SINGLE OR MULTI-WAY JOINT

(71) Applicant: Peter James Bucklitsch, Crowborough (GB)

(72) Inventor: Peter James Bucklitsch, Crowborough (GB)

( * ) Notice: Subject to any disclaimer, the term of this patent is extended or adjusted under 35 U.S.C. 154(b) by 0 days.

(21) Appl. No.: 16/734,034

(22) Filed: Jan. 3, 2020

(65) Prior Publication Data

US 2021/0207363 A1 Jul. 8, 2021

Related U.S. Application Data

(63) Continuation-in-part of application No. 16/708,466, filed on Dec. 10, 2019, which is a (Continued)

(30) Foreign Application Priority Data

Jun. 12, 2017 (GB) ..... 1709336
Jan. 10, 2019 (GB) ..... 1900364

(51) Int. Cl.
*E04B 1/61* (2006.01)
*E05D 7/10* (2006.01)

(52) U.S. Cl.
CPC ..... *E04B 1/54* (2013.01); *E05D 7/1044* (2013.01); *E05D 7/1083* (2013.01); *E05D 2007/1094* (2013.01)

(58) Field of Classification Search
CPC ..... E04B 1/54; E05D 7/1044; E05D 7/1083; E05D 2007/1094
(Continued)

(56) References Cited

U.S. PATENT DOCUMENTS 2,334,912 A * 11/1943 Eide ..... A47B 47/042 108/27
3,465,895 A * 9/1969 Hyman ..... A47B 57/402 211/191

(Continued)

FOREIGN PATENT DOCUMENTS

DE 1904738 A1 8/1970
DE 10061122 A1 6/2002

(Continued)

*Primary Examiner* — Brian D Mattei
*Assistant Examiner* — Joseph J. Sadlon
(74) *Attorney, Agent, or Firm* — Berenato & White, LLC

(57) ABSTRACT

A multi-panel kit defining one or more recesses for a structural joint. The kit including first and second panels for respectively defining first and second faces of the one or more recesses in use. One or more intermediate panels, each defining an intermediate face of at least one, of the one or more recesses in use, and one or more pairs of slots, each comprising a first slot through the first panel and a second slot through the second panel. The one or more recesses are intermediate the first and second panels, and the intermediate faces of each recess extending between the first and second faces of that recess. Each pair of slots is for receiving one of the one or more intermediate panels in use, and each of the one or more intermediate panels includes a first notch and a second notch for receiving an edge of the first slot and an edge of the second slot of a pair of slots respectively in use.

18 Claims, 18 Drawing Sheets

Related U.S. Application Data continuation-in-part of application No. PCT/IB2018/054249, filed on Jun. 12, 2018.

(58) Field of Classification Search
USPC ..... 52/578
See application file for complete search history.

(56) References Cited

U.S. PATENT DOCUMENTS 3,527,497 A * 9/1970 Self ..... A47C 3/029 297/440.13
3,788,700 A * 1/1974 Wartes ..... A47B 85/00 297/440.13
4,004,856 A * 1/1977 Wesseler ..... A47B 57/40 403/186
4,068,332 A 1/1978 Ball et al.
4,154,419 A * 5/1979 Breidenbach ..... A47B 57/402 108/110
4,312,454 A * 1/1982 Steffen ..... A47B 47/042 211/74
4,409,765 A 10/1983 Pall
4,558,968 A 12/1985 Meickl
4,592,286 A * 6/1986 Trubiano ..... A47B 57/545 108/108
4,673,308 A 6/1987 Reilly
4,729,484 A * 3/1988 McConnell ..... A47B 57/402 211/183
4,926,759 A * 5/1990 Vitsky ..... A47C 4/03 108/180
4,930,753 A * 6/1990 Alvyn ..... E04B 1/6158 16/262
4,966,309 A * 10/1990 Baer ..... A63G 9/00 248/165
5,012,555 A * 5/1991 Byers ..... E05D 11/08 16/342
5,052,580 A * 10/1991 Khoury ..... B60R 7/02 220/505
5,062,733 A 11/1991 Cholid et al.
5,127,760 A 7/1992 Brady
5,211,502 A * 5/1993 Upham-Hill ..... E04B 2/7425 160/229.1
5,275,467 A * 1/1994 Kawecki ..... A47C 4/021 297/411.29
5,351,453 A * 10/1994 Leslie ..... E04B 1/34321 446/110
5,617,694 A * 4/1997 Baba ..... E04B 1/2604 403/12
5,832,670 A * 11/1998 Bennett ..... E05D 7/02 49/382
6,446,396 B1 * 9/2002 Marangoni ..... A47B 96/027 108/50.02
6,481,678 B1 * 11/2002 Chong ..... H02G 3/288 211/192
6,669,396 B2 * 12/2003 Mattle ..... F16B 25/0031 403/294
6,843,025 B2 * 1/2005 Paz ..... E04B 1/34315 312/111
7,017,312 B1 * 3/2006 Mueller ..... E04B 1/2604 411/536
7,134,728 B1 * 11/2006 Buhrman ..... A47C 3/34 297/440.14
7,240,884 B2 * 7/2007 Shim ..... E04B 9/006 24/292
7,300,110 B1 * 11/2007 Debien ..... A47C 4/03 297/440.13
7,654,055 B2 * 2/2010 Ricker ..... A47B 47/0075 52/592.1
7,954,294 B2 * 6/2011 Appleford ..... E05C 3/045 52/582.2
8,028,846 B2 * 10/2011 Peota ..... A47F 5/0043 211/187
8,707,631 B2 * 4/2014 Scouten ..... E04B 1/3445 52/66
8,943,767 B2 * 2/2015 Lewis ..... E06B 5/01 52/200
8,955,286 B2 * 2/2015 Gadd ..... E04B 1/2608 52/712
9,010,068 B2 * 4/2015 Sullivan ..... E04F 13/0803 52/747.11
9,382,703 B2 * 7/2016 Quinn ..... E04B 1/61
9,441,658 B2 9/2016 Hemphill et al.
9,470,339 B2 * 10/2016 Zhang ..... E04B 1/1903
9,556,605 B2 * 1/2017 Elliott ..... A47C 4/021
9,593,505 B2 3/2017 Pryor
9,615,663 B2 * 4/2017 Davis ..... A47B 96/145
9,828,794 B2 * 11/2017 Romeu Guardia .. A01K 1/0011
9,879,413 B2 * 1/2018 Castelli ..... E04B 1/1903
10,130,893 B2 * 11/2018 Heston ..... A63H 33/084
10,179,991 B2 * 1/2019 Houghton ..... E04B 1/2403
10,221,875 B2 * 3/2019 Bonney ..... E04B 1/2604 411/536
10,669,711 B2 * 6/2020 Parshad ..... E04B 2/7405
D891,229 S * 7/2020 Hohmann, Jr ..... E04B 1/2403 D8/354
2002/0193046 A1 * 12/2002 Zebersky ..... A63H 3/52 446/476
2007/0130848 A1 6/2007 Tsai
2008/0289268 A1 11/2008 Sarkisian
2010/0071296 A1 * 3/2010 Johansson ..... A63H 33/12 52/582.1
2013/0028657 A1 1/2013 Kenho
2013/0125497 A1 5/2013 Kumakawa et al.
2014/0059956 A1 3/2014 Kerian
2015/0292537 A1 * 10/2015 Frey ..... G09F 15/0018 52/578
2017/0268224 A1 9/2017 Sato
2019/0257071 A1 8/2019 Green
2021/0164223 A1 6/2021 Honarbakhsh et al.

FOREIGN PATENT DOCUMENTS

EP 1399629 A1 3/2004
EP 2432947 A1 3/2012
FR 1554634 A 1/1969
GB 743259 A * 1/1956 ..... E04B 1/6141
GB 743259 A 1/1956
JP 2014214542 A 11/2014
KR 20170020642 A 2/2017
WO WO2006015762 A1 2/2006
WO WO-2010134033 A1 * 11/2010 ..... E04B 9/30
WO WO2010134033 A1 11/2010

* cited by examiner

KIT FOR DEFINING A RECESS FOR A SINGLE OR MULTI-WAY JOINT

CROSS-REFERENCE TO RELATED APPLICATIONS AND CLAIM TO PRIORITY

This application claims the benefit of British Application No. GB 1900364.9, filed Jan. 10, 2019; and, is a continuation-in-part of U.S. application Ser. No. 16/708,466, filed Dec. 10, 2019, which is a continuation-in-part of International Application No. PCT/IB2018/054249, filed Jun. 12, 2018, which claims benefit to British Application No. GB 1709336.0 filed Jun. 12, 2017, the disclosures of which are incorporated herein by reference and to which priority is claimed.

FIELD OF THE INVENTION

The present invention relates to a kit for constructing a unit defining one or more recesses for joints. More specifically, the present invention relates to a kit comprising a plurality of panels which interlock in use so as to define one or more recesses for a joint.

BACKGROUND TO THE INVENTION

Framing operations in construction involve the connection together of structural members such as beams and posts using joints such as lap joints or mortise and tenon joints. Joints used in framing operations typically comprise one or more recesses cut into a first structural member which receive corresponding portions or projections of a second structural members.

Cutting recesses into structural members for forming joints during framing operation complicates and weakens the production and provision of such structural members. The present invention aims to provide a unit for defining joints for use in framing operations, so as to facilitate the interconnection of structural members in framing operations.

SUMMARY OF THE INVENTION

According to a first aspect of the invention there is provided a kit comprising a plurality of panels which interlock in use to define one or more recesses for a joint, the kit comprising: first and second panels for respectively defining first and second faces of the one or more recesses between the first and second panels in use; one or more intermediate panels each for defining an intermediate face extending between the first and second faces of at least one of the one or more recesses in use; and one or more pairs of first and second slots through the first and second panels respectively for receiving one of the one or more intermediate panels in use; wherein each of the one or more intermediate panels comprises first and second notches for receiving edges of the first and second slots of a pair of slots respectively in use.

The kit may further comprise one or more locking means for locking edges of the slots within the notches in use; a support panel for connecting the first and second panels to one or more external structural elements; and/or one or more means for securing external structural elements within the one or more recesses.

The multi-panel kit may be assembled so as to define the one or more recesses intermediate the first and second panels, each of the one or more recesses having a first face defined by the first panel, a second face defined by the second panel, and an intermediate face extending between the first and second faces which is defined by one of the one or more intermediate panels. The recesses may receive protrusions, ends or portions of other structural elements, which may be secured within the one or more recesses so as to define one or more joints.

The invention advantageously provides multi-panel kit which may be assembled so as to define a unit with one or more recesses for defining joints. Elements of external structural elements may then be received by and secured within the recesses so as connect them to the unit. The unit may thereby be used to interconnect a plurality of structural members in framing or other construction operations.

The kit comprises a plurality of panels which may be assembled in use such that they interlock to define a unit with one or more recesses. The kit may be provided either as an assembled unit in an 'in use' arrangement or in an unassembled kit arrangement. The unit being disassembleable into a plurality of panels may facilitate the storage, transportation, and/or assembly of the unit. In preferred embodiments the panels are substantially flat, thereby minimizing the volume of space occupied by a disassembled unit kit. The kit may advantageously be a flat pack kit.

Panels are typically broad thin pieces of material with two relatively large faces connected by one or more narrow edges. Faces of the first, second and intermediate panels preferably define the faces of the one or more recesses respectively and the first and second slots are preferably formed through the first and second panels respectively, between their opposite faces.

Panels (and/or faces thereof) are often flat, but may be curved or bent. In preferred embodiments, one or both of the faces of one, some, or each of the first, second and intermediate panels are flat. Alternatively, or additionally, one or both faces of one, some, or all of the first second and intermediate panels may comprise flat portions; such flat portions may define first, second and/or intermediate faces of the one or more recesses.

In preferred embodiments each of the first, second and/or intermediate faces of one, some, or all of the one or more recesses are flat and are defined by flat portions of the first, second and intermediate panels respectively. In further preferred embodiments, the first, second, intermediate and/or optional support panels are flat panels.

The kit comprises a first panel for defining a first face of each of the one or more recesses in use and a second panel for defining a second face of each of the one or more recesses respectively in use. The one or more recesses being defined between the first and second panels (and the first and second faces defined thereby) in use by an intermediate panel or panels.

In preferred embodiments, the first and second panels are substantially flat, such panels may have two parallel flat and/or planar faces separated by a constant thickness. In such embodiments, the first and second faces of the one or more recesses defined by the flat faces of the first and second panels will themselves be flat and/or planar. The first and second panels being flat may also advantageously reduce the volume occupied by the panels when the unit is disassembled, thereby facilitating their transport and storage.

In alternative embodiments, one or both of the first and second panels may be bent and/or curved or may comprise bends and/or curved portions.

In preferred embodiments, the shapes of the faces of the first panel are generally or substantially identical or congruent to, the faces of the second panel. The first and second panels preferably have generally or substantially equal thicknesses and may have generally or substantially identical three-dimensional shapes in their entirety. For example, the first and second panels may be identical and/or interchangeable.

In some embodiments, the shapes of the first and second panels may be generally or substantially identical with the exception of portions of one or both of the first and second panels for connecting the assembled unit to some other structure in use. For example, one or both of the first and second panels may comprise one or more notches, indents, cut-outs or protruding elements for connecting to other structures, such as posts or columns used in farming operations. These features may be the only differences in the shapes of the first and second panels.

The first panel, second panel, one or more intermediate panels and/or other components (such as the optional locking means and/or the optional support panel) may comprise or may be formed from wood, such as softwood timber, hardwood timber or plywood, from metal, such as steel or aluminium, or from composite materials, such as fibreglass, carbon fibre or glass fibre reinforced resin.

In preferred embodiments, the first and second panels are an upper and lower panel, one of which is arranged above the other in use. In such embodiments the upper panel may define an upper face of each of the one or more recesses and the lower panel may define a lower face of each of the one or more recesses in use.

In preferred embodiments the first and second panels are arranged each with a face facing generally, substantially or directly towards a face of the other of these panels. These faces preferably defining the first and second faces of the one or more recesses intermediate the first and second panels.

In preferred embodiments, the first and second panels are arranged substantially parallel to each other in use. Such panels are preferably held in such a parallel arrangement by the one or more intermediate panels. For example, the unit may comprise a plurality of intermediate panels with equally spaced parallel pairs of parallel notches, when the panel is assembled in use, the first and second notches of each intermediate panel receive portions of the first and second panels extending form the edges of a slot formed therethrough, thereby holding the first and second panels in a parallel arrangement.

Alternatively, only part of the first panel is parallel to part of the second panel. For example, a portion of a face of the first panel may be parallel to a portion of a face of the second panel, these portions may define the first and second faces of one of the one or more recesses.

As a consequence of the first and second panels being parallel or otherwise, the first and second faces of the one or more recesses defined by the first and second panels may be substantially parallel to each other in use.

In particularly preferred embodiments, the first and second panels are substantially flat and are arranged and/or held substantially parallel to each other in use. In such an arrangement, the first and second faces of the one or more recesses are flat and parallel to each other. When substantially flat first and second panels are arranged substantially parallel to each other the first and second panels are preferably located substantially within and/or are substantially aligned with a pair of parallel planes. In some embodiments one or both faces of the first panel may be arranged and held parallel to one or both faces of the second panel in use.

Two surfaces such as panel faces are parallel if any line normal to one of the surfaces is also normal to the other, consequently each point on one of the surfaces will be offset from a corresponding point on the other surface by a fixed offset distance in the direction of the normal to the surfaces at the points; the fixed offset distance being equal for each pair of corresponding points. Consequently, some curved and/or bent panels may be arranged with parallel surfaces as described above.

In preferred embodiments, the first and second panels may be arranged substantially horizontally in use. The first and second faces of the one or more recesses defined by the first and second panels may therefore be upper and lower parallel horizontal faces of the one or more recesses.

In preferred embodiments, at least a portion of the first panel (or a first face defining face thereof) is arranged parallel to and overlapping at least a portion of the second panel (or a second face defining face thereof). If a portion of one panel or face is parallel to and overlapping a portion of another panel or face, then any line normal to one of the overlapping portions will also be normal to the other portion.

For example, in embodiments with substantially flat first and second panels which are arranged parallel to each other, the panels may partially or entirely overlap when viewed along an axis normal to the panels in use.

In preferred embodiments one of the first and second panels completely overlaps the other in the in use assembled arrangement. In such arrangements any line normal to the completely overlapped panel is also normal to the overlapping panel.

In further preferred embodiments where the shapes of the faces of the first and second panels are substantially identical or congruent, the panels are arranged parallel and such that each panel completely overlaps the other in use. In such arrangements any line normal to one of the first and second panels will also be normal to the second panel. The two panels will therefore be arranged to define the bases of an imaginary right prism.

In some embodiments, the first and second panels are substantially flat and are arranged in use such that they are substantially horizontal, parallel to each other and one above the other. In such arrangements the first and second faces of the one or more recesses are flat, horizontal, parallel to each other and one above the other. The first face of each recess is preferably identically shaped to the second face of that recess and is preferably arranged directly above the second face such that they overlap; the recess will therefore be in the form of a right prism.

The first panel has one or more first slots formed therethrough and the second panel has an equal number of second slots formed therethrough, each first slot being paired with a second slot. Each pair of slots is for receiving one of the one or more intermediate panels in use such that the intermediate panel extends between the first and second panels and defines an intermediate face of the one or more recesses. Each intermediate panel is preferably received by and held within slots in the first and second panels in use which combine to create a pair of slots parallel to each other.

In preferred embodiments the unit comprises a plurality of pairs of slots. The number of pairs of slots may be equal to the number of intermediate panels, such that each pair of slots receives an intermediate panel in use and each intermediate panel is received by a pair of slots.

Alternatively, the number of pairs of slots may be greater than the number of intermediate panels. This may allow the unit to be assembled in multiple different configurations with different pairs of slots filled by intermediate panels and different recesses being defined, this may also allow additional side panels to be introduced to the unit, thereby defining additional recesses.

In preferred embodiments, the unit comprises at least two pairs of slots and at least one intermediate panel. In some embodiments, the unit may comprise one, two, three, four, six or eight pairs of slots containing one, two, three, four.

In preferred embodiments the sizes and/or shapes of each of the first slots may be identical to each other and the sizes and/or shapes of each of the second slots may be identical to each other. This may advantageously allow each of the intermediate panels to be received by any of the pairs of slots. In further preferred embodiments, the first slots are identically shaped and/or sized to the second slots. In such embodiments the first and second may be identical (being identically shaped and sized panels with identically shaped, sized and laid out slots).

In preferred embodiments the first and second slots are substantially rectangular. The slots are preferably elongate, are preferably of equal width to the intermediate panels and are preferably of equal thickness to the width of the notches in the intermediate panels.

The layout of the slots through the first panel are preferably substantially identical to the layout of the slots through the second panel. This may advantageously allow the first panel to be arranged parallel to and overlapping the second panel as described above, such that each of the first slots is parallel to and overlapping a second slot (which preferably defines the other slot of its pair). Such first and second notches may be formed through identically shaped first and second panels as described above.

In use, the first slot of each pair of slots is preferably arranged parallel to the second slot of that pair, such that a flat intermediate panel may be received by both slots of the pair simultaneously. Such slots are also preferably arranged such that they overlap, for example, such that any imaginary line through the first slot of the pair and normal to the first panel also passes through the second slot and is normal to the second panel. In such an arrangement the pair of slots may receive and hold a flat intermediate panel orthogonal to the first and second panels.

One, some or all of the first and second slots may be perpendicular to an edge of the panel through which they are formed. In some embodiments, one, some or all of the first and second slots are perpendicular to the closest edge of the panel through which they are formed. In some such embodiments each of the slots through one or both of the panels may be adjacent, closest and perpendicular to a different edge of that panel.

In embodiments comprising a plurality of pairs of slots, some or all of the pairs of slots may be parallel to each other (with parallel first slots and parallel second slots) and/or some or all of the pairs of slots may not be parallel to each other.

In some embodiments comprising a plurality of pairs of slots, one or more of the pairs of slots may be parallel to and arranged side-by side to another pair of slots. In such an embodiment the two parallel and adjacent pairs of slots may receive and hold a pair of parallel and adjacent intermediate panels in use, such panels may define two intermediate faces of the same recess which may extend from opposite sides of the first and second faces of the recess. Such a recess may be a mortise, such as a through mortise, for defining a mortise and tenon joint. Such parallel pairs of slots preferably comprise slots of the same length which are preferably formed through the first and second panels such that any width-wise line through the first slot of one pair also passes through the first slot of the other pair and any width-wise line through the second slot of one pair also passes through the second slot of the other pair.

In some embodiments the unit may comprise multiple sets of multiple parallel pairs of slots, such sets of parallel pairs of slots may be not parallel to each other. For example, a unit comprising four pairs of slots may comprise a first set of two parallel adjacent pairs of slots and a second set of two parallel adjacent pairs of slots at right angles to the first set.

In some embodiments which comprise a plurality of pairs of slots, at least two pairs of slots may not be parallel to each other (with first slots which are not parallel to each other and second slots which are not parallel to each other). In such embodiments, the assembled unit may define a plurality of recesses with at least two recesses with intermediate faces which are not parallel to each other. For example, in some assembled units, at least two pairs of slots may be at right angles to each other so as to define two recesses with intermediate faces at right angles to each other, which may receive two external structural elements at right angles to each other in use, thereby defining a corner joint.

In particularly preferred embodiments, the first and second panels each comprise two slots at right angles to each other, so as to form two pairs of slots which are at right angles to each other in use. Such a kit may be assembled to define a corner joint unit.

In other particularly preferred embodiments, the first and second panels may each comprise three slots, two of which are parallel to each other and one of which is intermediate to the two parallel slots and at right angles to them, so as to form three pairs of slots, two parallel pairs of slots and an intermediate pair of slots at right angles to them. Such a kit may be assembled to define a T-junction joint unit.

In other particularly preferred embodiments, the first and second panels may each comprise four slots, each of which is at right angles to the other two slots between which it is arranged, so as to form four pairs of slots with right angles between them. Such a kit may be assembled to define a four-way X-shaped joint unit.

In some embodiments, each of the first and second panels may comprise a central portion with a plurality of arm portions extending therefrom, each arm portion may have one or more slots formed therethrough which may be aligned with the length of the arm. The number of arm portions of each panel may be equal to the number of pairs of slots. Such panels may be L-shaped (comprising two extending arm portions at right angles to each other), may be T-shaped (comprising three extending arm portions, two of which are parallel to each other and one of which is at right angles to the other two), or may be X-shaped (comprising four extending arm portions, each arm portion being at right angles to the two other arm portions between which it is located).

In some embodiments, the first and second panels may comprise additional elements for receiving, supporting and/or connecting to a support or vertical panel. Such elements may be located on or at a central portion intermediate a plurality of arm portions as described above. Such elements may be notches formed in an edge of the first and second panels or slots formed through the first and second panels. A support panel may be inserted into, held within, and/or supported by such slots or notches. The support panel preferably extends on either side of the first and second panels in use and may be for connecting the assembled unit to one or more external structures such as vertical columns or posts (such as vertical structural members used in framing operations).

The kit comprises one or more intermediate panels, each for defining an intermediate face of at least one of the one or more recesses in use. Each of the one or more intermediate panels comprises a first notch for receiving an edge of the first slot of a pair of notches and a second notch for receiving an edge of the second slot of the same pair of notches. In use each of the intermediate panels is received by one of the one or more pairs of slots such that it defines an intermediate face of at least one of the one or more recesses, the intermediate face extending between the first and second faces of that recess.

In use the intermediate panels extend between and interconnect the first and second panels; the intermediate panels preferably also lock and support the first and second panels in their in use assembled arrangement (for example, parallel and overlapping as described above).

For example, the kit may comprise flat first and second panels with a plurality of pairs of slots and a plurality of intermediate panels with equally separated pairs of parallel notches of equal width to the thickness of the first and second panels. In such an embodiment, the intermediate panels are each inserted into one of the pairs of slots and portions of the first and second panels extending from edges of the slots are inserted into the notches. The first and second panels are therefore held parallel to the slots and by extension each other with equally separated pairs of slots.

In some embodiments, in use, one, some, or all of the one or more intermediate panels may define intermediate faces of two of the recesses. For example, the two faces of one, some, or all of the intermediate panels may define an intermediate face of one of two recesses on opposite sides of that intermediate panel.

In preferred embodiments the kit comprises a plurality of intermediate panels. The kit may comprise an equal number of intermediate panels to the number of pairs of slots. Each of the plurality of intermediate panels may be identically shaped, this may allow each intermediate panel to be received by any of the pairs of notches.

In preferred embodiments, one, some or all of the intermediate panels are substantially flat. Consequently, or otherwise, the intermediate faces of the one or more recesses defined by one, some or all of the one or more intermediate panels may be flat and/or planar. Such flat and/or planar faces may be arranged at right angles to flat and/or planar first and second panels in use such that the one or more recesses have rectangular cross sections.

In alternative embodiments, one, some, or all of the intermediate panels may be bent and/or curved or may comprise bends and/or curved portions. Consequently, or otherwise, one, some or all of the intermediate faces of the one or more recesses may be bent and/or curved.

Each of the one or more intermediate panels comprises a first notch for receiving an edge of the first slot of a pair of slots and a second notch for receiving an edge of the second slot of that pair of slots.

In use each of the one or more intermediate panels may be arranged such that it extends through the first and second slots of a pair of slots and edges of said slots are inserted into the notches of the intermediate panels. The first, second and one or more intermediate panels preferably thereby support each other.

In preferred embodiments the notches are rectangular and may form cuboid cut-outs from the intermediate panels, this may allow them to securely receive portions of the first and second panels with constant thicknesses. The notches are preferably formed in an edge or side of the intermediate panel comprising them and preferably extend between the opposite faces of the intermediate panel, thereby defining a cut-out in the panels profile.

The first slots of the one or more intermediate panels are preferably all identically shaped. The width of the first slots may be equal to the thickness of the first panel. Alternatively, or additionally, the second slots of the one or more intermediate panels are preferably all identically shaped. The width of the second slots may be equal to the thickness of the second panel. The first and second notches of each intermediate panel, and/or of all of the intermediate panels, may be of equal length. In preferred embodiments the first and second notches of each intermediate panels are identically shaped to each other and preferably to the first and second notches of all of the one or more intermediate panels.

The first and second notches of each intermediate panel are preferably parallel to each other. The first and second notches of each intermediate panel are preferably formed in the same side and/or edge of the intermediate panel and are preferably perpendicular to the edge in which they are formed.

The separation between the first and second notches of the one or more intermediate panels (and of the optional support panel) may define the separation between the first and second panels and the size of the one or more recesses, for example where each intermediate panel (and optionally the support panel) comprises equally separated pairs of notches. This may allow differently sized intermediate (and optional support panels) to be used with the same first and second panels in order to define differently sized recesses, for example, different recesses corresponding to different sizes of timber. In some embodiments the kit may comprise multiple intermediate panels with differently spaced notches for each pair of slots, thereby allowing the kit to be assembled to define recesses with differently sized recesses. As such the size of recesses defined by the kit may be adjusted to suit the available materials in a framing operation.

One, some, or all of the one or more intermediate panels may comprise one or more intended corners, each of which may in use define a gap for receiving, or a shoulder for supporting, a locking means within one of the pair of slots which receives the panel.

The indented corner or corners may be corners of an edge of the intermediate panel opposite from the edge in which the notches are formed. For example, one, some, or all of the intermediate panels may be rectangular panels with two notches formed in a first edge and two indented corners at opposite ends of a second edge, the second edge being on the opposite side of the panel from the first edge.

Alternatively, the intermediate panel may be generally or substantially rectangular and each of its four corners may be indented, in some such embodiments, the notches of the intermediate panel may be formed in edges of indented corners.

The indented corners may comprise rectangular indents from the corner. The rectangular corners may be indents in corners between perpendicular edges of the intermediate panel and such rectangular indents may comprise two edges, each of which is parallel to one of the perpendicular edges that the indented corner is between.

In preferred embodiments, one, some, or all of indented corners may comprise an edge which is aligned with and parallel to an edge of one of the notches of the intermediate panel.

The edge of the indented corner is preferably aligned with an edge of the notch closest to the indented corners, for example, in a generally rectangular intermediate panel with a pair of notches formed in a first edge, an indented corner between a second edge perpendicular to the first edge and a third edge parallel to the first edge on the opposite side of the panel may be aligned with an edge of the notch closest to the second edge.

In intermediate panels which are arranged generally or substantially vertically in use, an indented corner between the upper edge of the intermediate panel and an edge opposite the edge in which the notches are formed may be aligned with an edge of the upper of the two notches and/or an indented corner between the lower edge of the intermediate panel and an edge opposite the edge in which the notches are formed may be aligned with an edge of the lower of the two notches.

The edge of the indented corner is preferably aligned with the edge of a notch which is closest to the other of the two notches. Such an edge is preferably arranged in use such that it contacts the face of one of the first and second panels which defines the first or second faces of the one or more recesses, the indented corners will therefor extend from an edge of the intermediate panel outside of the first and second panels, into the notch, thereby providing a recess for receiving and a shoulder for supporting some other element such as a locking means.

In particularly preferred embodiments, each of the intermediate panels is generally rectangular and comprises two notches in a first edge and two indented corners between a second edge (which is parallel and opposite to the first edge) and the third and fourth edges (which extend between and perpendicular to the first and second edges). The indented corners comprise two edges at right angles to each other. The indented corner closest to the first notch comprises an edge aligned with and parallel to the edge of the first notch closest to the second notch, and the indented corner closest to the second notch comprises an edge aligned with and parallel to the edge of the second notch closest to the first notch.

In some embodiments, one, some, or all of the one or more intermediate panels comprises a central portion (which is preferably rectangular), which defines an intermediate face of at least one recess in use, and two outer portions on opposite sides of the central portion, each of which is located within one of the slots and on the far side of that slot from the central portion in use. The two notches are each formed in one of the two outer portions with an edge along the boundary between the central and outer portion.

In preferred embodiments the outer portions are generally or substantially L-shaped such that they each define one of the first and second notches between themselves and the central portion.

In preferred embodiments the central portion is longer (in the direction of the length of the notches) than the outer portions, as such indented corners may be defined between the central and outer portions as described above. In such embodiments the central portion may advantageously be longer than the length of the slots, so that central portion is unable to fit through the slots, but the outer portions are. The length of outer (preferably L-shaped) outer portions is preferably substantially equal to the length of the first and second slots.

In use, the intermediate panels may be arranged substantially vertically. For example, the unit may be arranged with substantially horizontal first and second panels defining upper and lower faces of the one or more recesses with one or more vertical intermediate panels at right angles thereto and extending therebetween, in such embodiments the recesses may be substantially rectangular.

In preferred embodiments, the first and second slots and notches are substantially cuboid, the width of each of the first and second slots is equal to the width of each intermediate panel, the width of each first notch is equal to the width of the first panel, and the width of each second notch is equal to the width of the second panel. Such kits may be assembled with the intermediate panels received by the first and second slots, and the first and second panels received by the first and second notches, such that the first, second and intermediate panels are unable to rotate with respect to each other.

In some embodiments, the lengths of the first and second notches is equal to the length between the narrow end of each rectangular first or second slot, and an edge of the first or second panel to which the first or second slot is perpendicular. In such embodiments, the edge of the intermediate panel will advantageously be aligned with the edges of the first and second panels in use.

The one or more recesses defined by the kit when assembled may have generally or substantially U-shaped or]-shaped profiles and/or cross sections, with the first and second faces defined by portions of the first and second panels being opposite (and preferably parallel to each other) and a single intermediate face defined by an intermediate panel extending therebetween.

In particularly preferred embodiments, one, some, or all of the intermediate panels may interlock with the first and second panels so as to define a I-shaped or ‡-shaped profile or cross section when viewed along the length of the intermediate panel, thereby defining two]-shaped recesses on either side of the intermediate panel, one or both of which may be for forming half of a joint.

Alternatively, or additionally, multiple intermediate panels may interlock with the first and second panels adjacent and parallel to each other so as to define recesses with multiple parallel intermediate faces, with rectangular enclosed profiles. Such recesses may be mortises such as through mortises.

In preferred embodiments, the kit comprises one or more locking means for securing edges of the first and/or second slots within the first and/or second notches in use. The locking means is preferably in the form of an element which fits into the first and/or second slot between the intermediate panel received therein and the edge of the slot opposite the edge of the slot received by the notch of the intermediate panel.

Such a locking means may advantageously prevent the intermediate panel being displaced with respect to the first and/or second panel such that the slot edge is displaced out of the notch, thereby allowing the intermediate panel to be displaced out of the slot.

The locking means may be in the form of a block of material, such as cuboid block. Such a block may be supported within the first and/or second slot upon a shoulder of the intermediate panel defined by an indented corner as described above. Such a cuboid block may advantageously have a width and height generally or substantially equal to the first and second panel (and by extension the first and second slot) and may have a length equal to the length of first and second slots minus the distance between the base of the first and second notches and the edge of the intermediate panel opposite the edge in which the notches are formed (such a length may be equal to the length of the first and second notch).

In alternative embodiments, the locking means may be a pin, wedge or other element for inserting into the first or second slots adjacent the intermediate panel.

In some embodiments, the kit may comprise the same number of locking means as the number of pairs of slots or may comprise twice as many locking means as pairs of slots.

In some embodiments, the kit comprises one or more means for connecting to external structural elements outside of the one or more recesses. Such a means may be a support panel for connecting the first and second panels unit to one or more external structural elements. Such a support panel may interlock with the first and second panels such that it extends on the far side of the first and second panels from the one or more recesses (i.e. on the far side of the first panel from the second panel and on the far side of the second panel from the first panel) in use.

These extending portions of the support panel may then connect with other structural elements face to face. In use the support panel may be connected to one or more external structures (such as vertical posts used in framing operations), for example by glue, by welding, and/or by one or more screws and/or bolts. Such extending portions may comprise one or more apertures formed therethrough, for example for receiving bolts.

In preferred embodiments the support panel is substantially flat and may be arranged orthogonal to the first and second panels, parallel to one or more of the intermediate panels, and/or substantially vertically in use. The support panel may be generally or substantially rectangular.

In particularly preferred embodiments, the support panel comprises a pair of notches one of which is for receiving a portion of the first panel in use and the other of which is for receiving a portion of the second panel in use. In such embodiments, the first and second panels may each comprise a notch in one of their edges for receiving a portion of the support panel. In such embodiments, each of the notches in the support panel may interlock with the notch in one of the first and second panels in use so as to define a halved joint or a lap joint (which is preferably an edge lap joint, and/or a cross lap joint).

The notches formed in the edges of the support, first and second panels are preferably rectangular and elongate and may be perpendicular to the edges in which they are formed. The notches in the first and second panels may be formed in edges of the central portions of the first and second panels as described above.

The width of the two notches formed in the support panel is preferably equal to the thicknesses of the first and second panels and the width of the notches formed in the edges of the first and second panels are preferably equal to the thickness of the support panel. The length of the notches formed in the edges of the first and second panels may be equal to the width of the support panel minus the length of the notches formed in the support panel, in such embodiments, edges of the first, second and support panel may advantageously be flush in use.

In some embodiments, the support panel may a central portion intermediate its two notches and two outer (preferably square or rectangular) portions, each on the far side of one of the notches from the central portion. In use one such outer portion will extend past the first panel on the far side from the one or more recesses and the other outer potion will extend past the second panel on the far side from the one or more recesses. External structural elements may be connected to the outer portions face to face in use, and the outer portions may each comprise one or more apertures therethrough for facilitating such connections.

In alternative embodiments, the kit may comprise other means for connecting to external structural elements outside of the one or more recesses. For example, the kit may comprise one or more panels with T-shaped cross sections which are mounted on the first and second panels on the opposite side from the one or more recesses in use.

In some embodiments the kit may comprise one or more means for securing external structural elements within the one or more recesses and/or to a panel for connecting to such elements outside of the one or more recesses as described above. Such means may be bolts which may extend through panels of the kits or may be pins which may extend into or across one of the one or more recesses.

In preferred embodiments, one, some, or all of the intermediate panels comprise one or more apertures intermediate their first and second slots through which such bolts or pins may extend in use. For example, each intermediate panel may comprise four apertures for bolts arranged in a square between the panel's first and second notches, in use an external structural element such as the end of the beam may be arranged within (preferably substantially filling) a recess whose third face is defined by the intermediate panel, such that it contacts the intermediate panel face to face. Bolts or screws may then extend through the apertures in the intermediate panel into or through the external structural element.

In embodiments comprising multiple intermediate panels with differently spaced notches, the number of apertures may vary with the separation between the notches.

In embodiments comprising multiple intermediate panels which are arranged parallel and adjacent to each other in use so as to define a mortise, one or more pins or bolts may extend through multiple intermediate panels and across the mortise recess defined between them.

In use the panels of the kit interlock so as to define the one or more recesses. Each of the intermediate panels is inserted part way through a first slot in the first panel and a second slot in the second panel paired therewith, such that the intermediate panel's first and second slots are aligned with first and second panels respectively. The first and second panels may then be slid into the first and second notches of the intermediate panel such that the intermediate panel is no longer free to be displaced through the slots. Optionally locking means may be inserted into the slots so as to prevent the first and/or second panels being slid out of the slots and/or a support panel may be inserted into notches in the first and second panels as described above.

In preferred embodiments the panels are dimensioned such that they are held together in when assembled by their interlocking components (for example locking means may prevent the edges of the first and second slots from being displaced out of the first and second notches of the intermediate panels, which may be extension prevent the first and second panels from being displaced out of the pairs of slots).

The orientation of the interlocking panels with respect to each other may also be fixed by the shapes of the panels. For example, the notches may have equal widths to the first and second panels thicknesses, and the slots may have equal widths to the intermediate panels' thicknesses, thereby preventing the intermediate panels from rotating within the slots, and multiple intermediate panels may have equally separated first and second notches, thereby holding the first and second panels parallel to each other. In some embodiments, the fits between the first and second panels and the intermediate panel {an optionally the support panel) may be interference fit.

Alternatively, or additionally, one, some or all of the intermediate panels may connect to the first and/or second panels by screws or nuts and bolts, may be glued together (for example, wherein the panels are formed from timber or composite materials) and/or may be welded together (for example, wherein the panels are formed from metals such as steel). The optional support panel may also be connected to first and/or second panels in any of these ways.

In some embodiments the kit may be a flat-pack kit. In such embodiments the kit preferably comprises a plurality of flat panels, and optionally other small components such as locking means or bolts. A flat-pack unit may be transported and/or stored as a compact flat package and may be assembled by a user.

According to a second aspect of the invention there is provided a unit constructed from a kit according to the first aspect of the invention which defines one or more recesses. The unit comprises a first panel and a second panel defining first and second faces of the one or more recesses respectively, the one or more recesses being intermediate the first and second panels; one or more intermediate panels defining an intermediate face of at least one of the one or more recesses in use, the intermediate faces of each recess extending between the first and second faces of that recess; each of the intermediate panels being received by a pair of slots comprising a first slot through the first panel and a second slot through the second panel, wherein each of the one or more intermediate panels comprises a first notch and a second notch receiving an edge of the first slot and an edge of the second slot of a pair of slots respectively. The unit may comprise any of the optional features described above with reference to the first aspect of the invention.

According to a third aspect of the invention there is provided a system comprising a plurality of kits according to the present invention. The system may further comprise additional components, such as one or more joist hangers, rafter hangers, ridge supports, beams, posts, columns, rafters, ridge boards, and/or studs.

According to a fourth aspect of the invention there is provided a corner insert, former or unit for use with a structure, the insert, former or unit comprising: first and second corner frame elements (such as first and second panels as described above) each having at least two limbs, each limb having at least one aperture (such as a slot as described above) formed therethrough, each aperture being dimensioned and arranged to receive a stave (such as an intermediate panel as described above) whereby staves locate in corresponding apertures to connect respective limbs and thereby maintain the frame elements parallel to each other such that outer edge of the frame elements define planes which in use are parallel to walls of the structure.

The corner, insert, or unit may further comprise any of the optional components or features of the kits or units described above, such as a support panel, one or more locking means, or the corner frame elements being identically shaped.

Preferred embodiments of the invention will now be described, by way of example, with reference to the figures.

DETAILED DESCRIPTION OF THE FIGURES

Referring to the figures generally there are shown multi-panel kits 100,200,300 according to the first aspect of the present invention and units 101, 201, 301 constructed from the kits 100, 200, 300. The units 101, 201, 301 each define a plurality of recesses 180 for receiving other structural elements so as to define joints.

Figure 1:
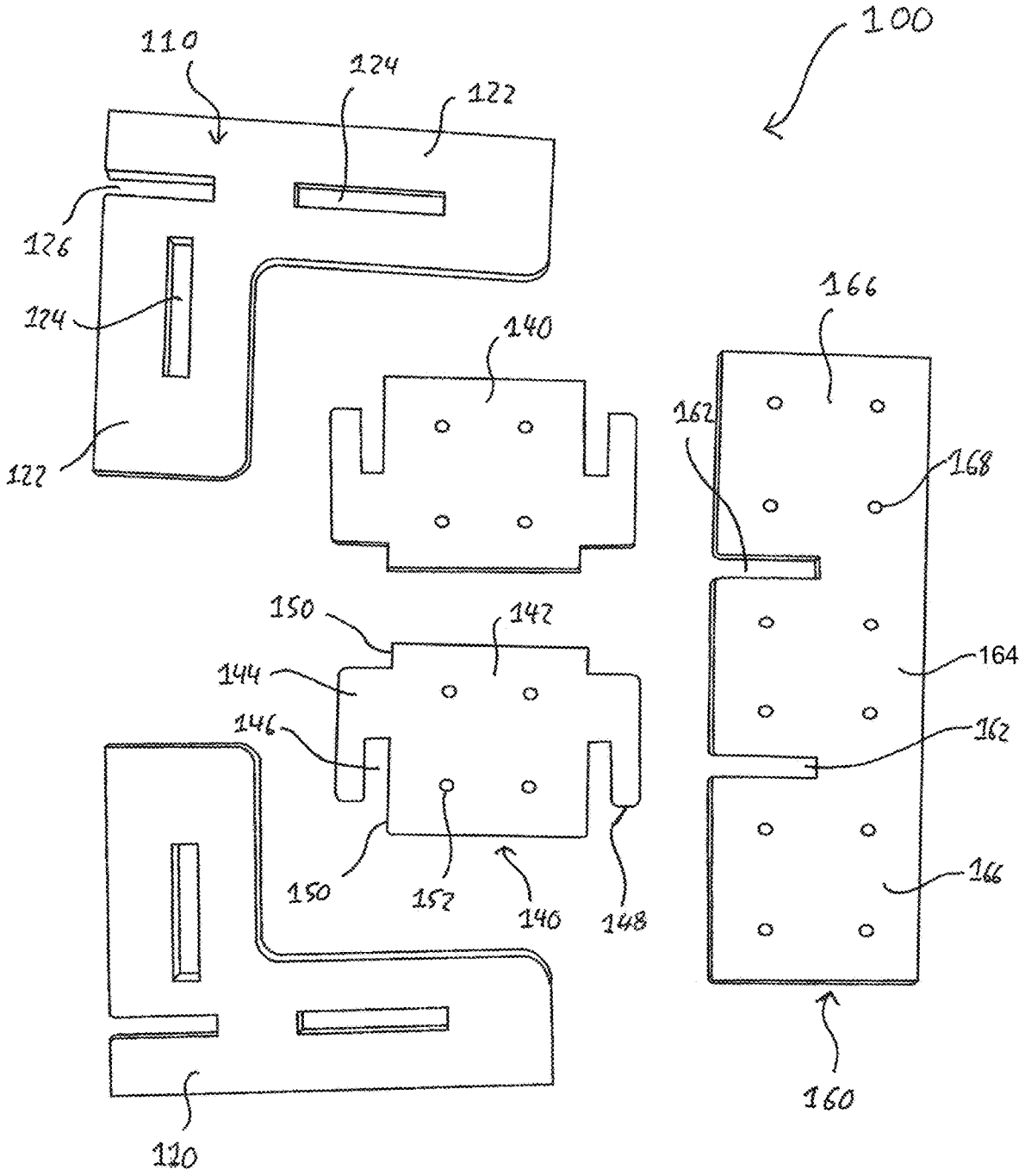
FIG. 1 is an overall view of an unassembled kit according to the present invention for constructing a unit defining two recesses for joints at right angles to each other.

FIG. 1 shows a first multi panel kit 100 for constructing a unit 101 with recesses 124 at right angles to each other. The kit 100 comprises two identical panels 110, two identical intermediate panels 140, and a support panel 160.

The panels 110 are identically shaped flat panels of constant thickness which are arranged horizontally, parallel and one above the other when the kit is assembled in use. The upper and lower panels 110 are generally L-shaped and comprises two generally rectangular arm portions 122 extending at right angles to each other.

Two elongate rectangular slots 124 are formed through each of the upper and lower panels 110. The slots 124 are each located within and parallel to one of the two arm portions 122, such that the two slots are at right angles to each other.

A single elongate rectangular notch 126 is formed in an edge of each of the upper and lower panels 110, 120. Each rectangular notch 126 is parallel to and aligned with one of the two slots 124 of its panel 110 and perpendicular to the other slot 124 of the other panel 110. The notches 126 are therefore formed in an edge of each of the upper and lower panels 110 in the corner between the two extending arm portions 122.

In use, the slots 124 through the upper and lower panels 110 define two pairs of slots 124, each comprising a first upper slot 124 and a second lower slot 124. In use the first upper slot 124 of each pair is arranged directly above and parallel to the second lower slot 124 of the pair, and each pair of slots receives and holds one of the intermediate panels 140.

A corner kit comprises two intermediate panels 140 which are identically shaped flat panels of constant thickness which are arranged vertically in use, each within one of the pairs of slots 124.

The intermediate panels 140 each comprise a generally square central portion 142 which in use is arranged between the upper and lower panels 110 and two generally L-shaped outer portions 144 which fit into and through the pair of slots 124 which receive the intermediate panel 140. Each of the two L-shaped outer portions 144 defines a notch 146 between itself and the central portion 142, the closed base end of the notch 146 being approximately half along the length of the L-shaped portion 144 and of the central portion 142.

The lengths of the L-shaped outer portions 144 are substantially equal to the lengths of the slots 124 through the first and second panels 110 such that the outer portions 144 can be inserted through the slots 124 with the intermediate panel 140 orthogonal to the first and second panels 110 such that the notches 146 are coplanar with the first and second panels 110.

In use the intermediate panels 140 are inserted into the slots 124 with the open ends of their notches 146 facing towards the ends of the arm portions 122 in line with or at right angles to the first or second panel's central notch 126.

The length of the central portion 142 of each intermediate panel 140 in the direction of the length of that intermediate panel's notches 146 is greater than that of the L-shaped portion 144 and of the upper and lower slots 124. Consequently, the central portion 142 of the intermediate panels 140 is too large to fit through the slots 124 of the upper and lower panels 110.

As a consequence of the difference in length between the central portion 142 and the outer portions 144 of the intermediate panel 140, the outer portion of the intermediate panel 140 has indented corners 148 at one end of the outer portion 144. The indented corners 148 comprise rectangular indents 146 with edges parallel and/or at right angles to the edges of the intermediate panel 140. The indented corners 150 define shoulders on the edges of the central portion 142 on the closed side of the L-shaped portion 144. When the L-shaped outer portions 144 of the intermediate panel 140 are inserted into the upper and lower slots 124, the shoulders 150 will abut the lower face of the upper panel 110 and the upper face of the lower panel 110, thereby preventing the central portion 142 of the intermediate panel from being displaced into the slot 124 and aligning the notches 146 of the intermediate panel 140 with the first and second panels 110.

After the intermediate panel 140 has been inserted into the slots 124 of the first and second panels 110, the intermediate panel 140 may be slid lengthways within the panels such that the open ends of the notches 146 in the intermediate panel 140 are slid into the slots 124 until the end of the slot 124 contacts the base of the notches 126. As such a portion of each of the first and second panels 110 parallel to and extending from the end of the slots 124 towards the end of the arm portion 122 comprising the slot will be received within the notch 146. The intermediate panel 140 thereby interlocks with the first and second panels 110 at right angles to them.

The thickness of the intermediate panel 140 is substantially equal to the width of the slots 124 through the first and second panels 110 and the thicknesses of the first and second panels 110 are substantially equal to the width of the notches 146 in the intermediate panel 140. As such the intermediate panel 140 is unable to rotate within the slots 124 and the first and second panels are unable to rotate within the notches 146, therefore the intermediate panels 140 are held and maintained at right angles to the first and second panels 110.

The length between the edge of the central portion 142 of the intermediate panel 140 at the open end of the notches 146 and the closed base end of the notches 146 (which is the length of the interior lengthwise edge of the notch 146 plus the length of a shoulder 150 of the intermediate panel 140) is equal to the length between the end of each of the arm portions 120 of the upper and lower panels 110 and the closest end of the slot 124 aligned with and formed through that arm portion 120. As such, when this end of the slots 124 is slid into the notch 146, the edge of the central portion 142 of the intermediate panel 140 is aligned with the end edge of the arm portion 122 of the first and second panels with which it interlocks.

In use, each of the intermediate panels 140 interlocks with an arm portion 122 of the upper and lower panels 110 to define an arrangement with an "F"-shaped profile and cross-section when viewed along the length of the notches 146 and slots 124. As such, each intermediate panel 140 and upper and lower arm portion 122 defines two]-shaped recesses 180, each with a first upper face defined by the upper panel 110, a second lower face defined by the lower panel 110 and an intermediate face extending between the upper and lower faces defined by the intermediate panel 140.

In use, external structural elements, such as the ends of beams may be inserted into one of the recesses 180 defined between each upper and lower arm portion 122 and secured therein so as to define joints. Such external structural elements are preferably dimensioned to substantially fill the recess and to contact the upper, lower and intermediate faces of the recess 180 face to face. The assembled unit 101 may therefore interconnect two such external structural elements at right angles to each other.

In the one of the illustrated embodiments, the two intermediate panels 140 each comprise four circular apertures 152 extending through their central portions 142. In use, bolts may be arranged to extend through the apertures and corresponding apertures in external structural elements received within the recesses 180, so as to secure the external structural element within the recess. The four illustrated apertures 152 are arranged in a square arrangement. It is envisaged that the intermediate panels may be provided without apertures (for example, such that screws may be used to secure external structural elements within the recesses) or with a different number or arrangement of apertures.

The kit comprises a single support panel 160 for securing the assembled unit 101 to external structural elements outside of the recesses 180 defined between the first upper and second lower panels 110, 120. In particular, the support panel is for securing the unit 101 to vertical structural elements at right angles to those received within the recesses 180 (such as posts or columns used in framing operations).

The support panel 160 is a flat substantially rectangular panel of constant thickness which is arranged vertically in use orthogonal to the first panel 110, the second panel 110 and one of the intermediate panels 140, and coplanar with the other of the intermediate panels 140.

The support panel 160 comprises two parallel elongate rectangular notches 162 formed in one of the long edges of the panel 160. In the illustrated panel each of the notches 162 is formed approximately one-third of the way along that edge from opposite ends of the panel 160, such that the support panel comprises a substantially square central portion 164 between the two notches 162 and two substantially square outer portions 166 each on the opposite side of one of the notches 162 from the central portion and at opposite ends of the panel 160. The separation between the notches 162 of the support panel 160 being equal to the separation between the notches 146 of the intermediate panels 140.

Figure 9:
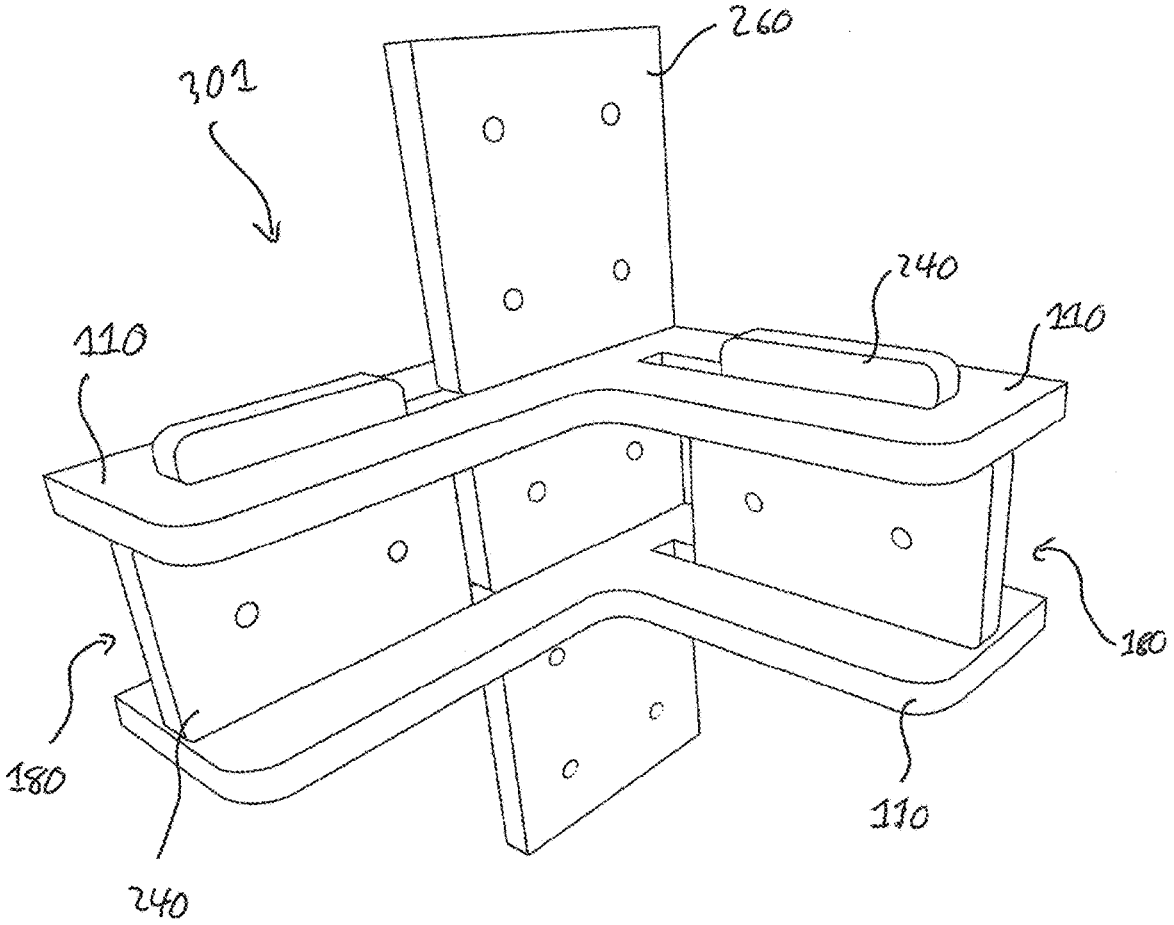
FIG. 9 is an overall view of a unit constructed from the kit of FIG. 8.
Figure 10:
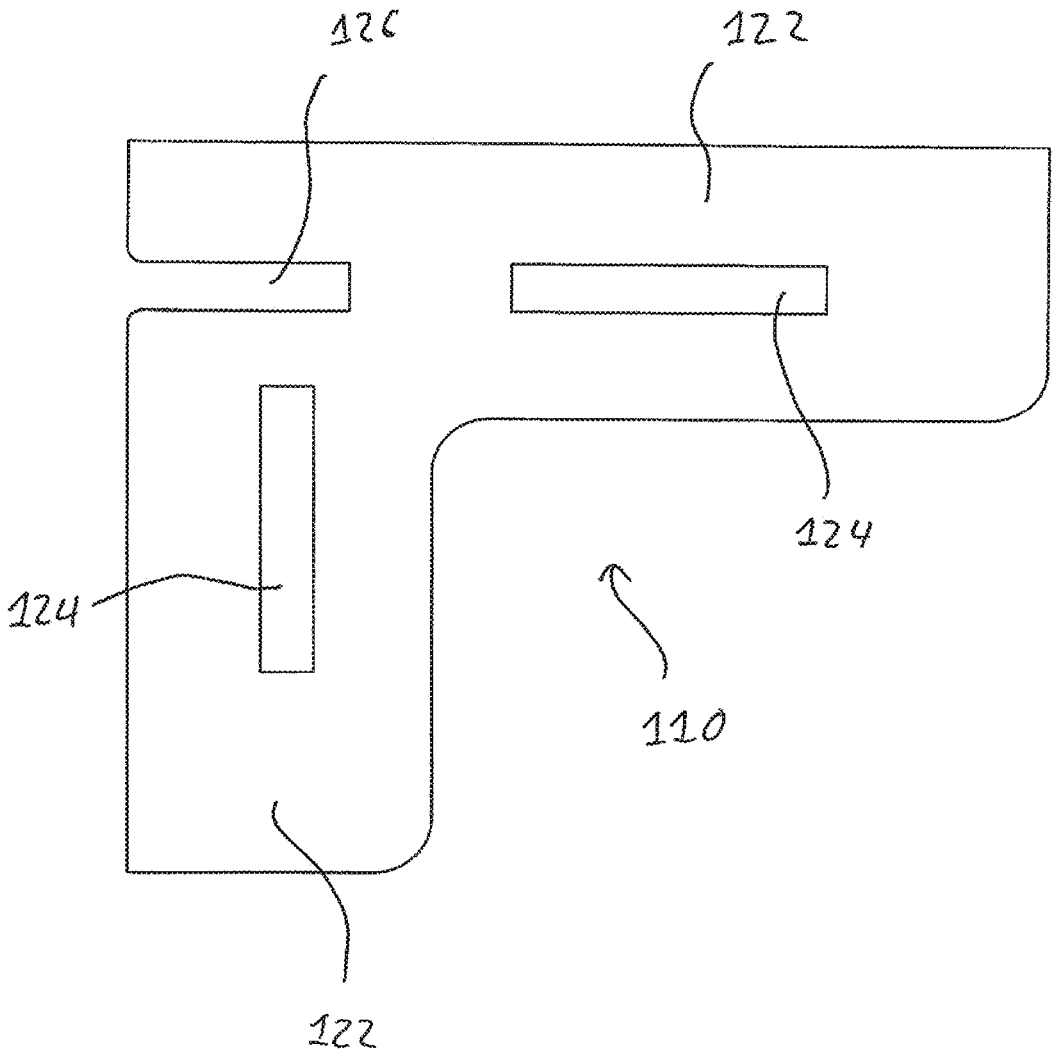
FIG. 10 is a plan view of one of the upper and lower panels of the kits of FIGS. 1 and 8.
Figure 11:
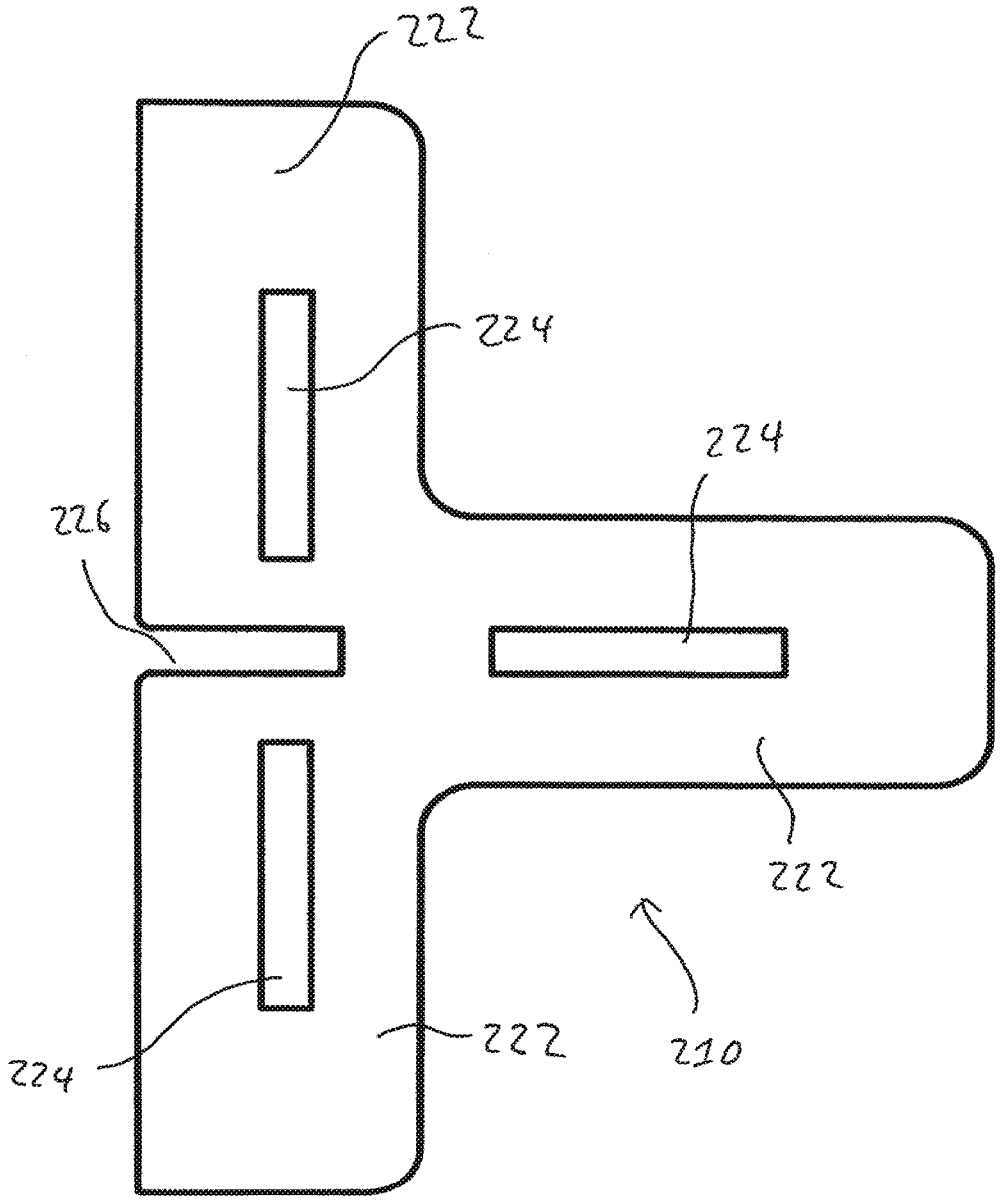
FIG. 11 is a plan view of one of the upper and lower panels of the kit of FIG. 4.
Figure 12:
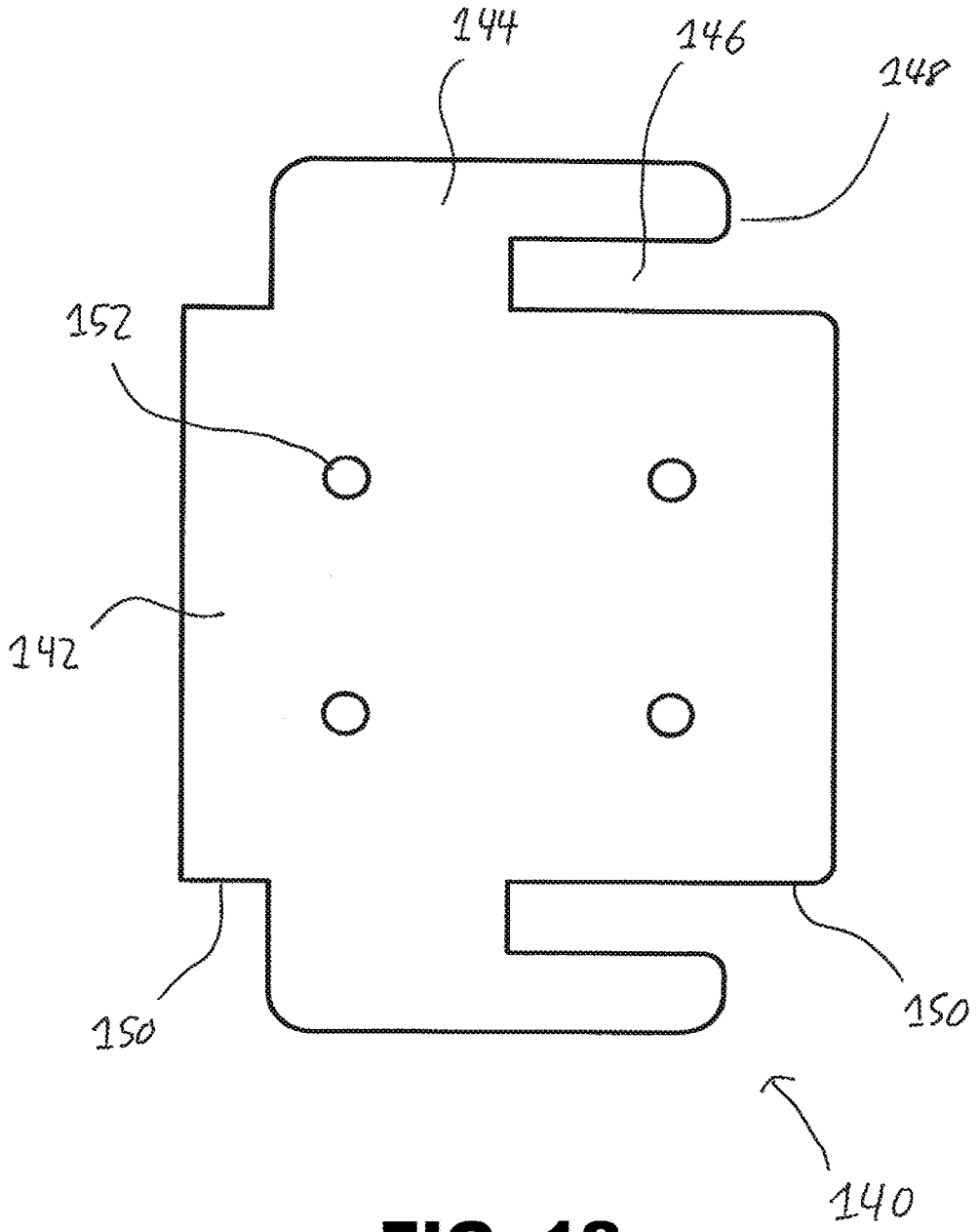
FIG. 12 is a plan view of one of the intermediate panels of the kits of FIGS. 1 and 4.
Figure 13:
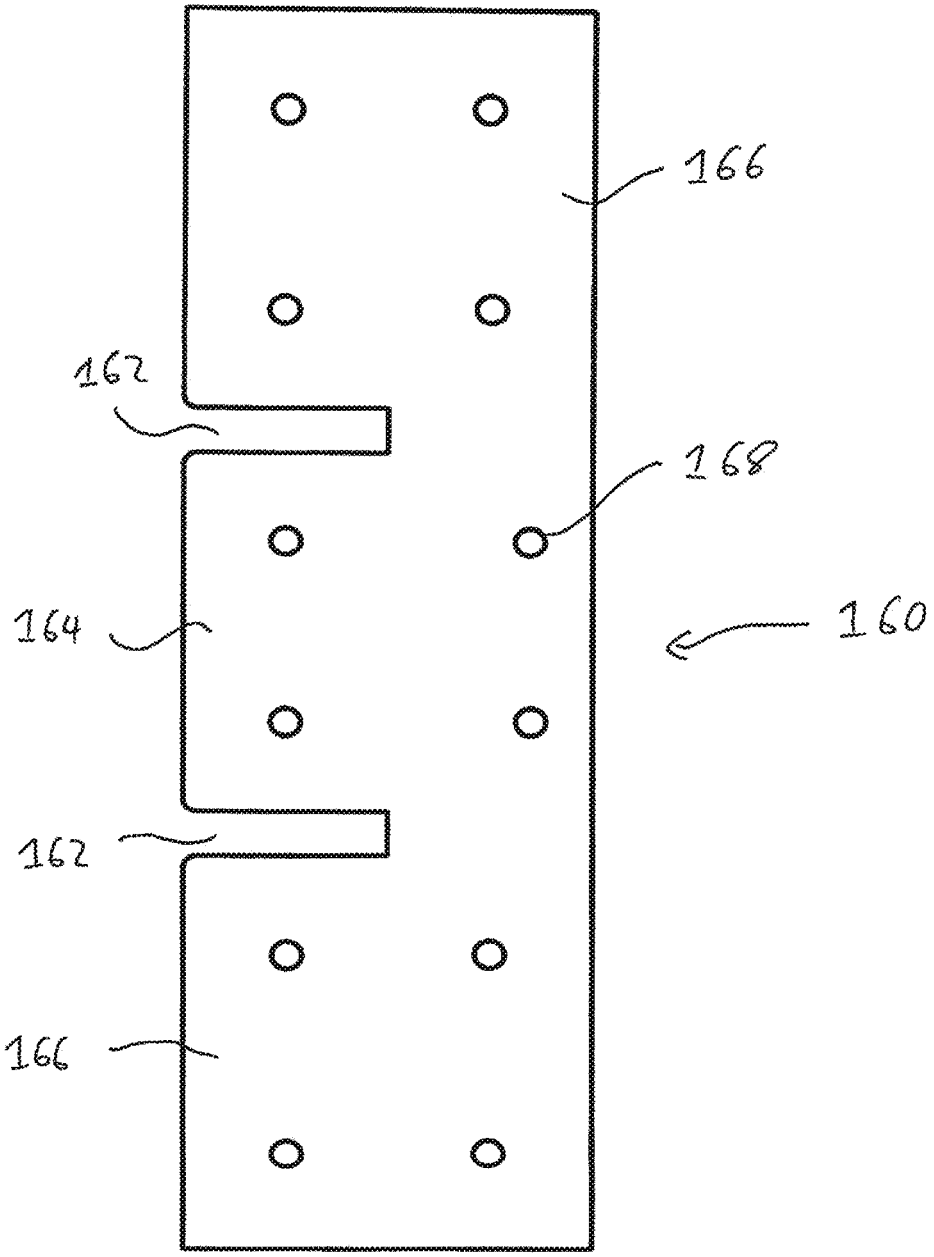
FIG. 13 is a plan view of the support panel of the kits of FIGS. 1 and 4.
Figure 14:
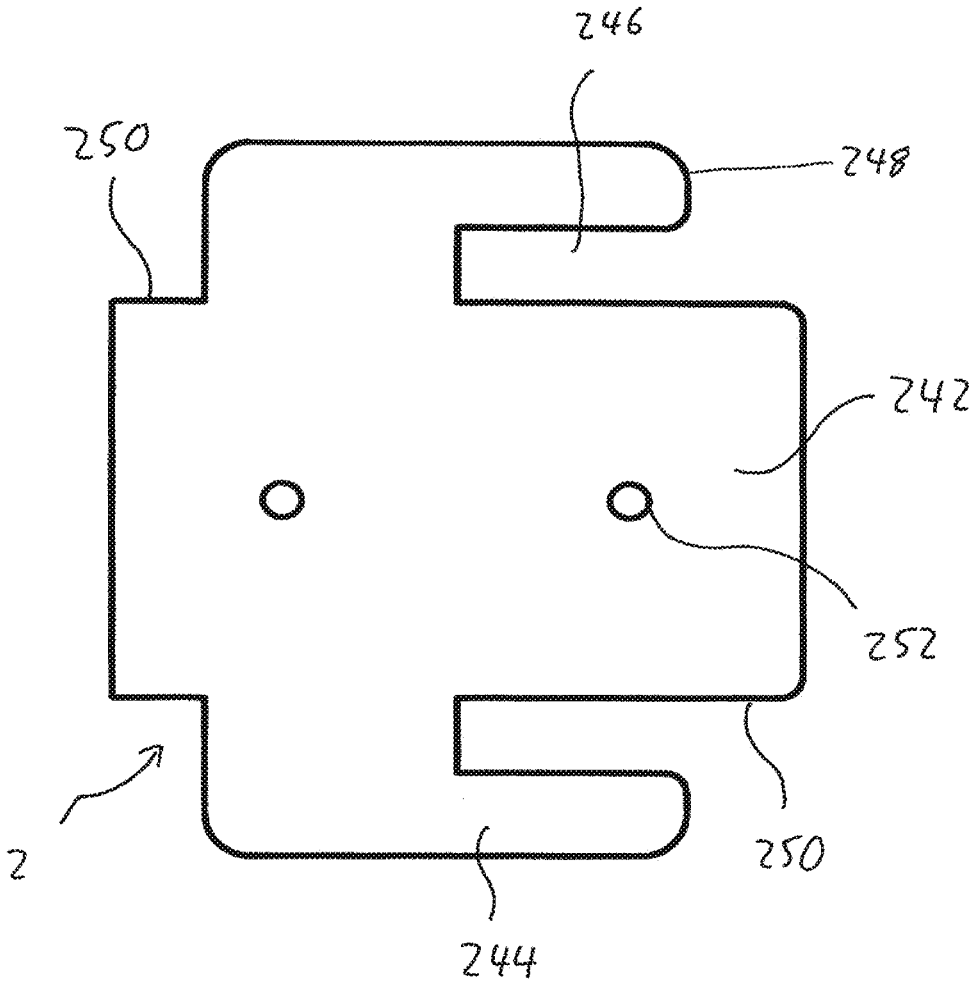
FIG. 14 is a plan view of one of the intermediate panels of the kit of FIG. 8.
Figure 15:
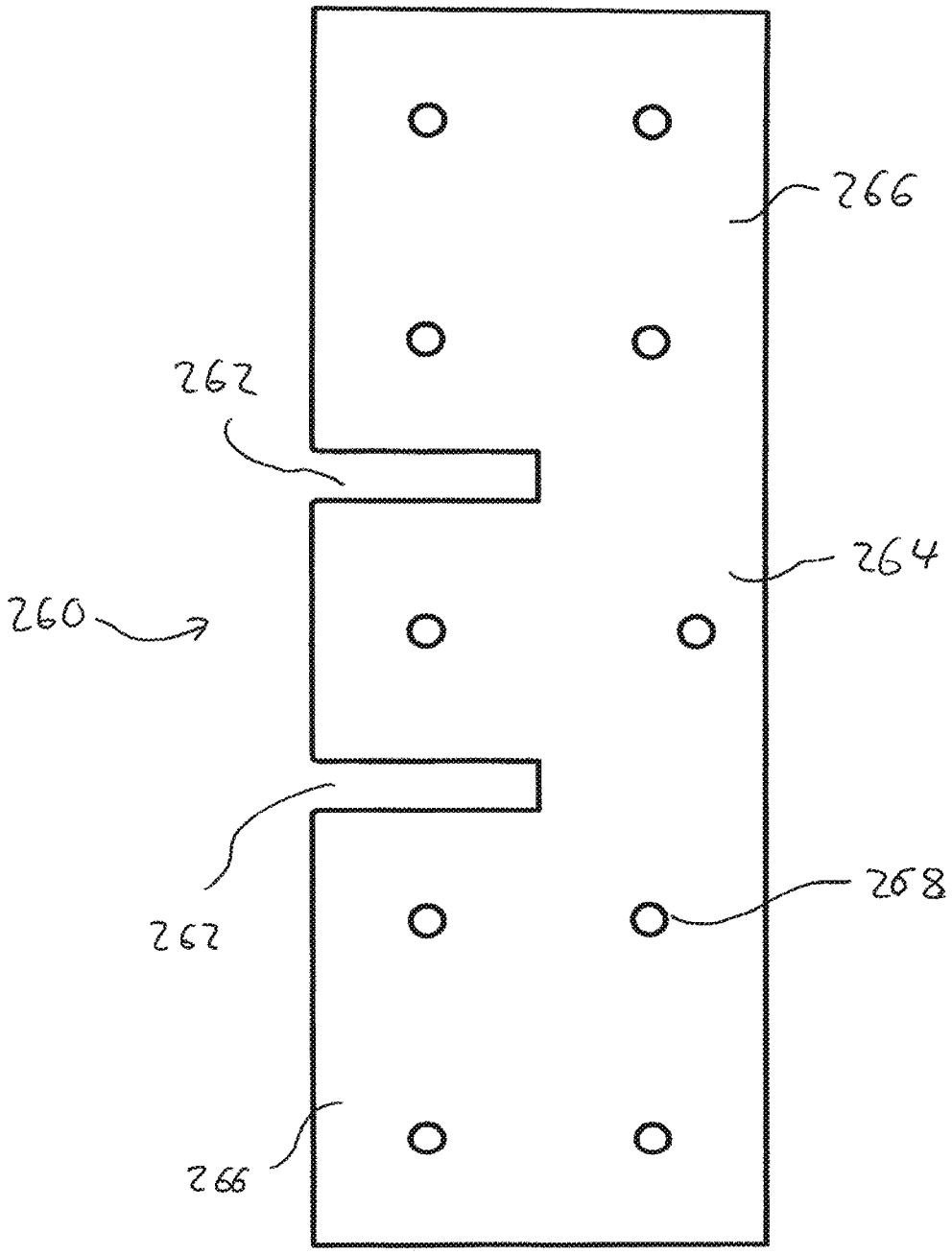
FIG. 15 is a plan view of the support panel of the kit of FIG. 8.

Alternative support panels and intermediate panels with different separations between their notches may be substituted for the intermediate and support panels 140, 160 so as to define recesses 180 of different sizes. Such an arrangement is shown in FIG. 9 with smaller intermediate panels 240 and a smaller support panel 260.

Figure 2:
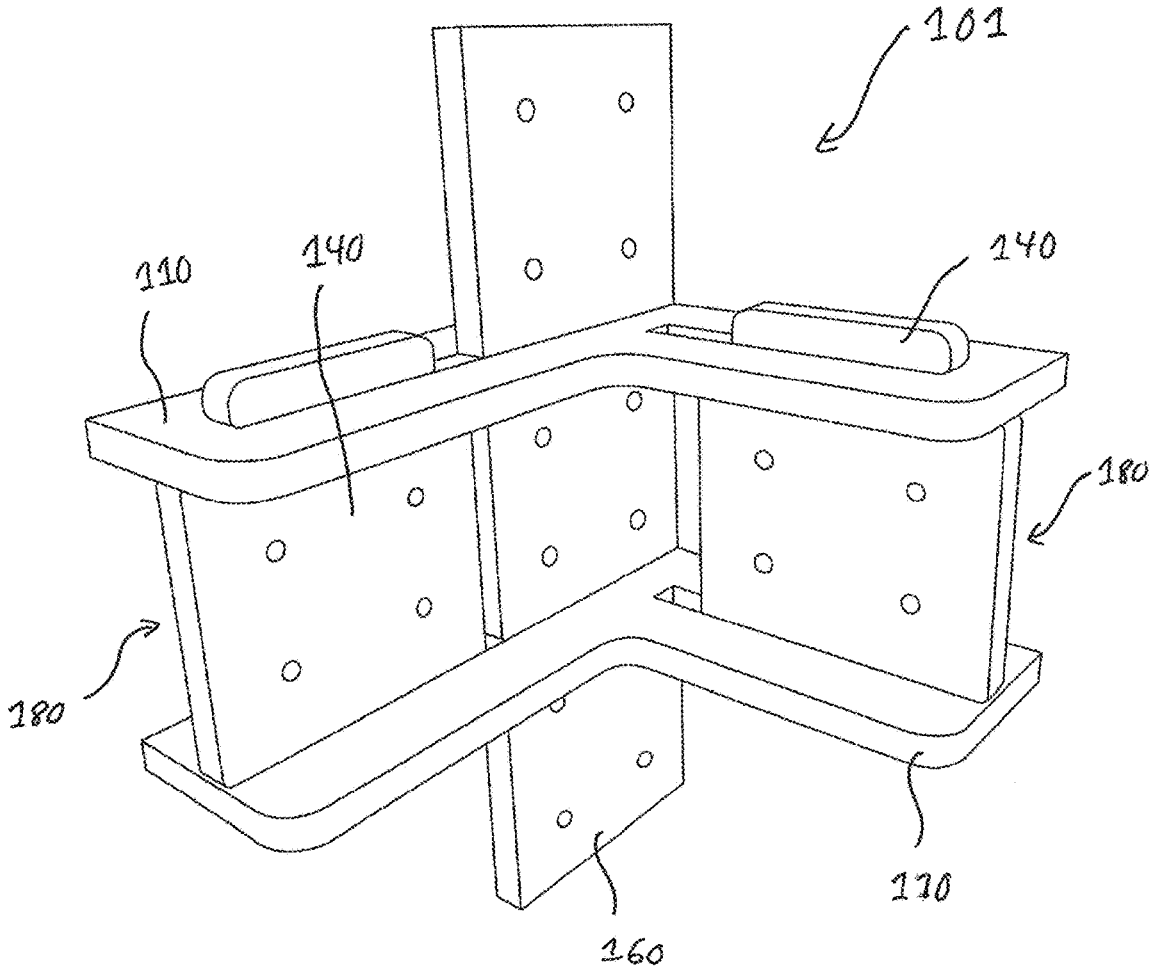
FIG. 2 is a first overall view of a unit constructed from the kit of FIG. 1.

In use the central portion is located between the first and second panels 110, one of the outer portions 166 is located on the far side of the first panel 110 from the second panel 110 (above the first panel 110 as shown in FIG. 2) and the other of the outer portions is located on the far side of the second panel 110 from the first panel 110 (below the second panel 110).

Apertures 168 for bolts are formed through each of the central and outer portions 163, 166 of the illustrated support panel 160 in square or offset square arrangements. In another embodiment the support panels may be provided without apertures (for example, such that screws may be used to secure external structural elements to the panel) or with a different number or arrangement of apertures.

In order to assemble the kit, the support panel 160 is arranged orthogonally the first and second panels 110 and is inserted into the notches 126 in the first and second panels 110 such that the closed base ends of the notches 126 in the first and second panels 110 contact the closed base ends of the notches 162 in the support panel. The notches in the first, second and support panels 110, 160 consequently define joints known as halved joints, cross lap joints or edge lap joints.

In the assembled configuration portions of the first and second panels extending from the ends of the notches 126 are received within the notches 162 of the support panel and portions of the support panel extending from the ends of the notches 162 are received within the notches 126 of the first and second panels. As such the support panel 160 is unable to rotate within the notches 126 and the first and second panels are unable to rotate within the notches 162, therefore the support panel 160 is held and maintained at right angles to the first and second panels 110.

External structural elements, such as the ends of beams may be received within the recesses 180 and secured therein (for example, using bolts passing through the apertures 152 through the intermediate panel 140) so as to define joints. A beam received by the recess 180 with an intermediate face parallel to the support panel 160 may be arranged extending through the recess 180 such that its end is adjacent and face to face with the central portion 164 of the support panel 160, to which it may be secured (for example by bolts passing through apertures 168). Such an arrangement may advantageously prevent the support panel from becoming displaced away from the intermediate panel 140 and out of the notches 126 in the first and second panels 110.

Other external structural elements, such as posts, columns or rafters may be secured face to face to the outer portions 166 of the support panel 160. For example, by bolts passing through apertures 168.

Figure 3:
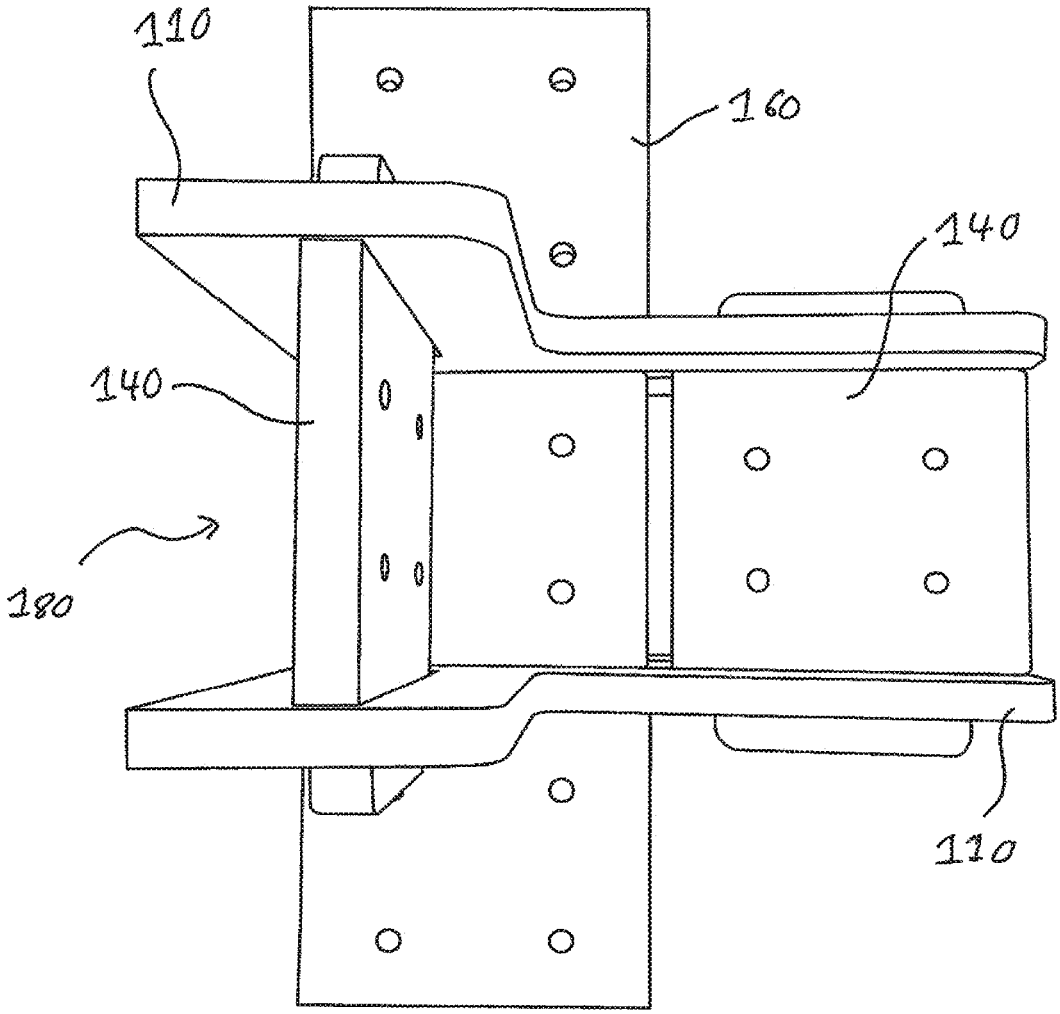
FIG. 3 is a second overall view of the unit of FIG. 2.
Figure 4:
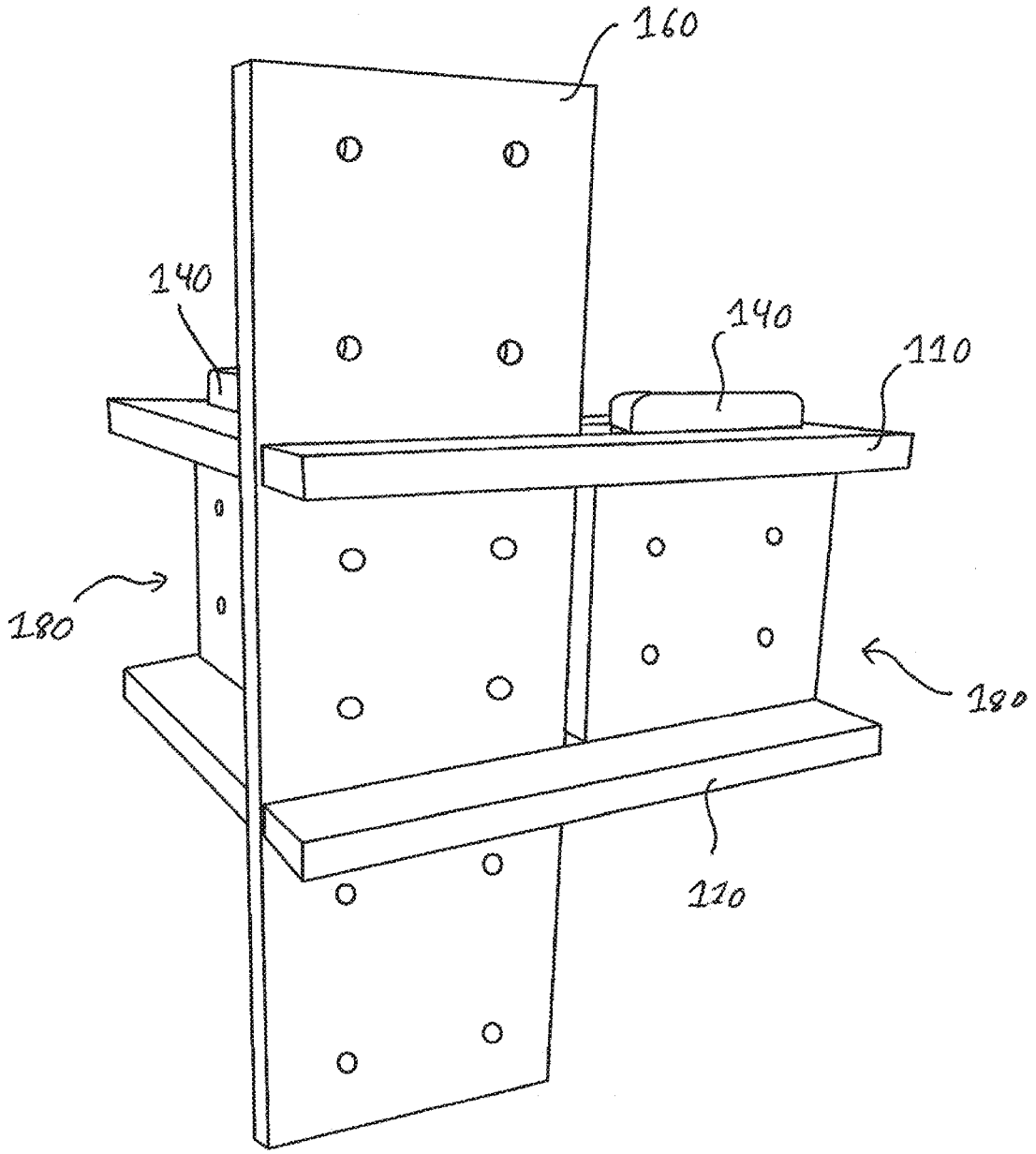
FIG. 4 is a third overall view of the unit of FIG. 2.

FIGS. 2 to 4 show overall views of the kit 100 assembled to define a unit 101 with recesses 180 at right angles to each other.

Figure 5:
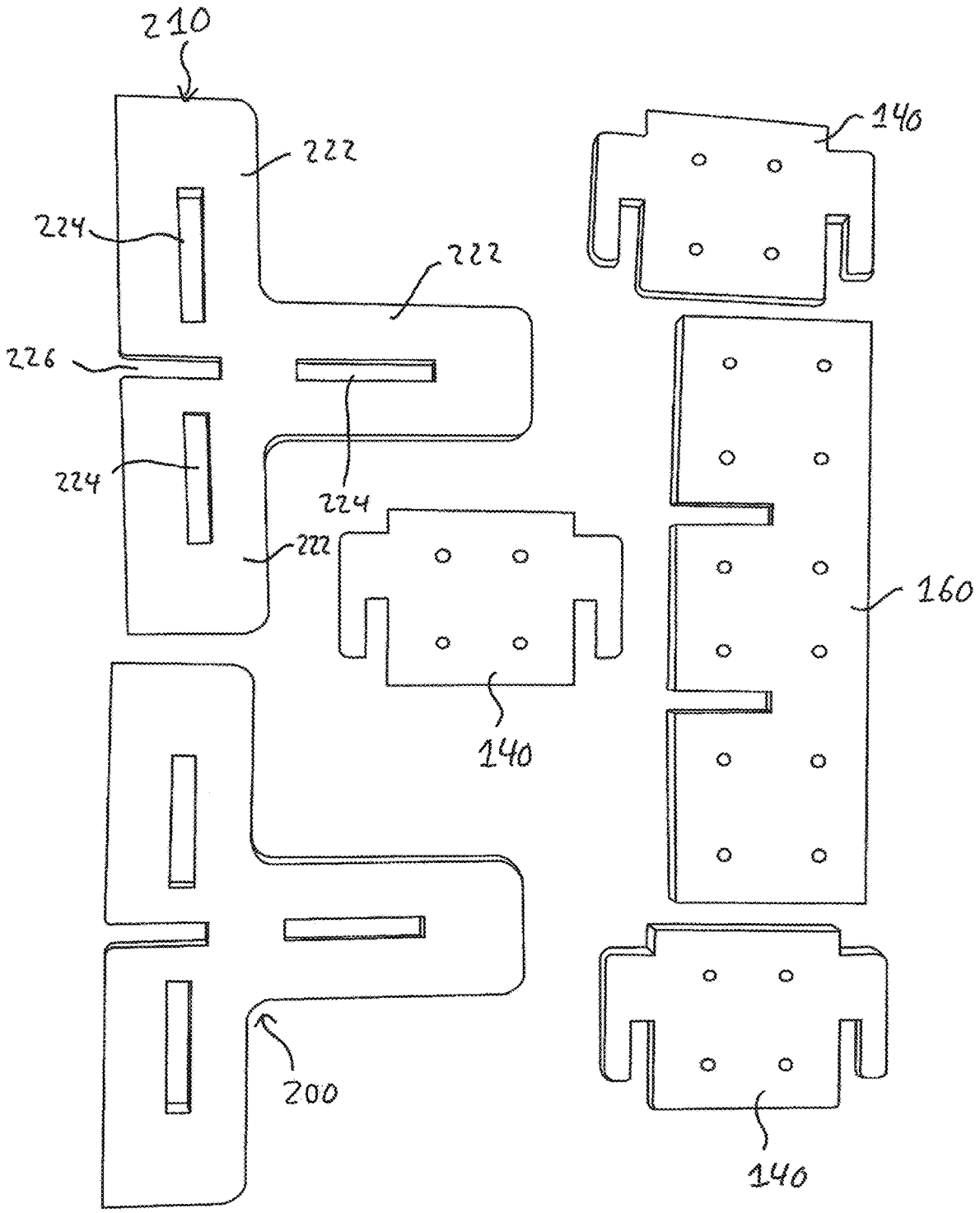
FIG. 5 is an overall view of an unassembled kit according to the present invention for constructing a unit defining three recesses for joints.

FIG. 5 shows a second multi panel kit 200 for constructing a unit 201 with recesses in a T-shaped arrangement. The kit 200 comprises a first upper panel 210, a second lower panel 220, three intermediate panels 140, and a support panel 160.

The three intermediate panels 140 are identical to the two intermediate panels 140 of the first multi-panel kit 100 described above and the support panel 160 is identical to the support panel 160 of the first multi-panel kit 100 described above with reference to FIGS. 1 to 4.

The first upper panel 210 and second lower panel 210 are similar to the upper and lower panels 110 of the first multi-panel kit 100 described above with reference to FIGS. 1 to 3 but differ in that they comprise three arm portions 222 and three slots 224 in a T-shaped arrangement.

The upper and lower panels 210 are identically shaped flat panels of constant thickness which are arranged horizontally, parallel and one above the other when the kit is assembled in use. Each of the upper and lower panels 210 is generally T-shaped and comprises three generally rectangular arm portions 222 extending from a central intersection point, two of the arm portions 222 extend parallel to each other in opposite directions from the intersection point and the third extends at right angles to the other two.

Three elongate rectangular slots 224 are formed through each of the upper and lower panels 210. The slots 224 are each located within and parallel to one of the three arm portions 222, such that the two slots are parallel and aligned with each other and the third is at right angles to the other two.

A single elongate rectangular notch 226 is formed in an edge of each of the upper and lower panels 210. Each rectangular notch 226 is located at right angles to and between the two parallel slots 224 such that it is parallel to and aligned with the third slot 224 of its panel 210. The notches 226 are therefore formed in an edge of each of the upper and lower panels 210 at the intersection point of the three arms 222.

In use, the slots 224 through the upper and lower panels 210 define three pairs of slots 224, each comprising a first upper slot and a second lower slot. and each pair of slots 224 receives and holds one of the intermediate panels 140.

In use the first upper slot 126 of each pair is arranged directly above and parallel to the second lower slot 126 of the pair, and each pair receives and holds a support panel 160.

Figure 6:
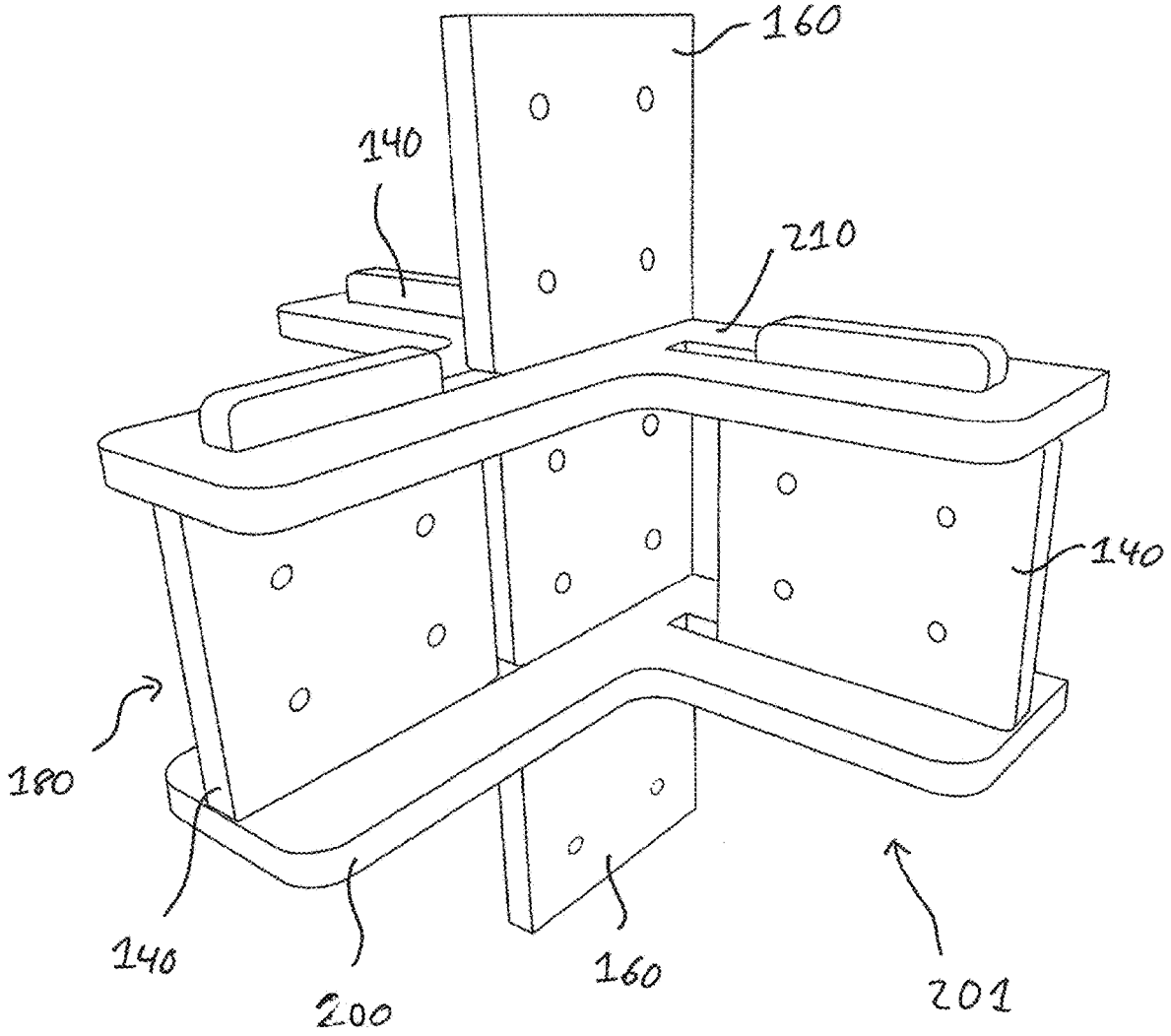
FIG. 6 is an overall view of a unit constructed from the kit of FIG. 5.

The second kit 200 is assembled in the manner as the first kit 100 so as to define a unit 201 with three pairs of recesses in a T-shaped arrangement. FIG. 6 shows the second unit 201 fully assembled.

Figure 8:
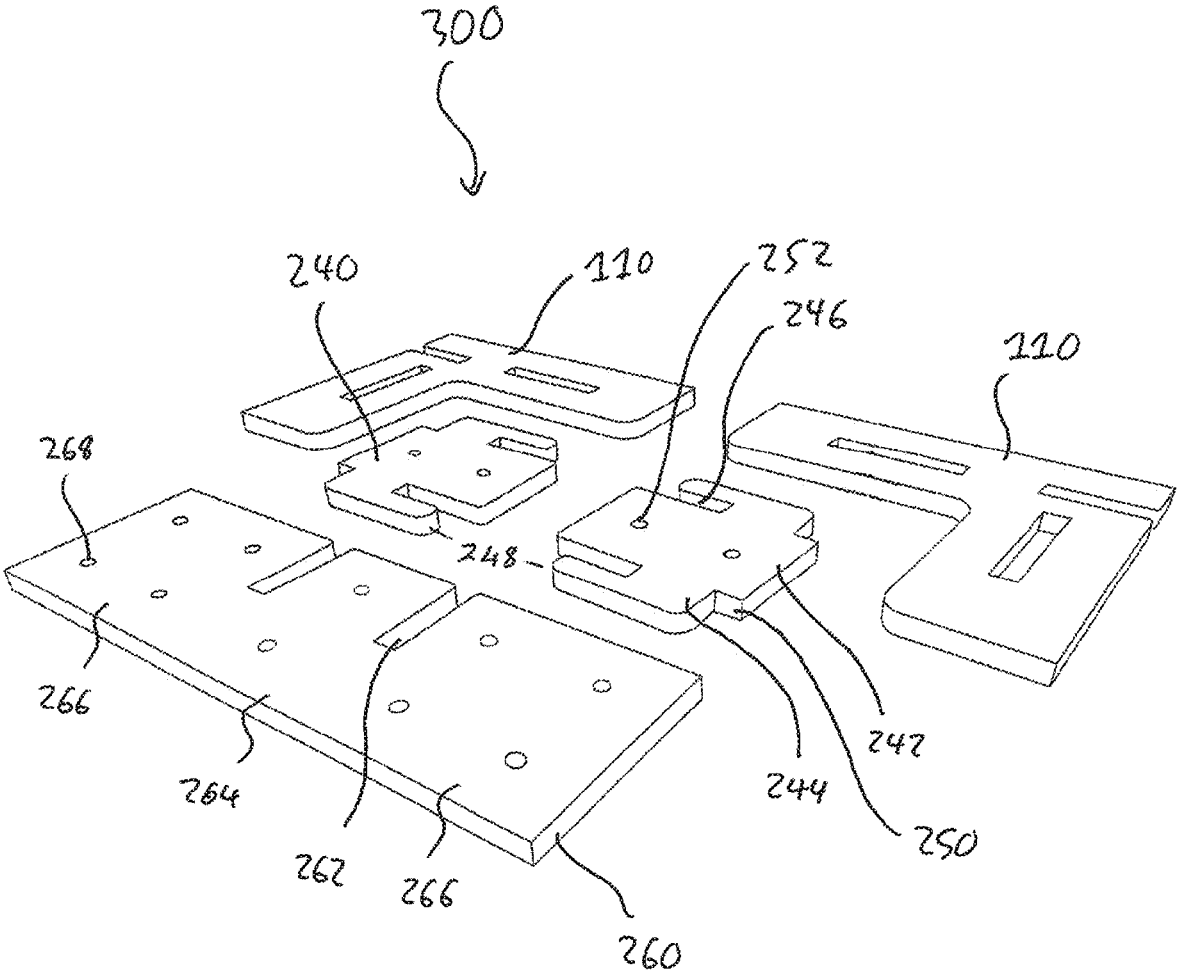
FIG. 8 is an overall view of an unassembled kit according to the present invention constructing two small recesses for joints at right angles to each other.

FIG. 8 shows a third multi-panel kit 300 for constructing a unit 301 with recesses 180 at right angles to each other, the recesses 180 defined by the unit 301 being smaller than the recesses defined by the units 101 constructed from the kits 100 for timber such as 145 mm×45 mm, and 200 which could be for timber sizes of 95 mm×45 mm described above. The kit 300 comprises a first upper panel 110, a second lower panel 110, two intermediate panels 240 and a support panel 260.

The first upper and second lower panels 110 are identical to those of the first kit 100 described above with reference to FIGS. 1 to 4.

The intermediate panels 240 and the support panel 260 are similar to the intermediate and support panels 140, 160 of the kits described above with reference to FIGS. 1 to 7 but differ in that their central portions 242, 264 between their notches 246, 262 are smaller rectangular portions with two apertures 252, 268 therethrough rather than being larger substantially square portions 142, 162 with four apertures 152, 168 therethrough. The first upper and second lower panels 110 are therefor held closer together when the unit 301, which is shown in FIG. 9, is assembled. The unit 301 therefor defines smaller recesses 180 for receiving smaller beam ends such as 75 mm×45 mm.

Figure 7:
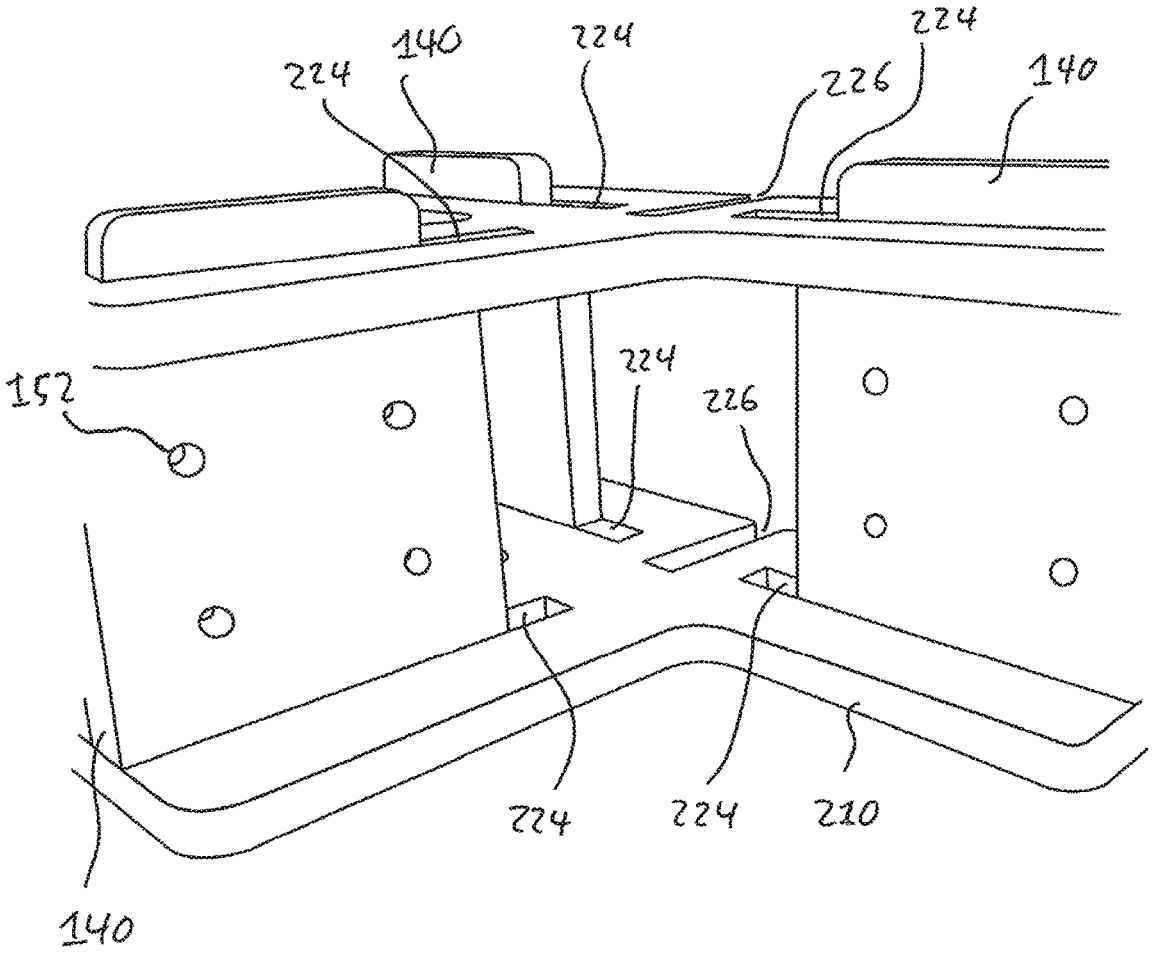
FIG. 7 is a partial view of a unit partially assembled from the kit of FIG. 5.

The smaller intermediate and support panels 240,260 may also be used with the T-shaped upper and lower panels 210 of the second kit 200 described with reference to FIGS. 5 to 7 so as to define a fourth kit with smaller recesses in a T-shaped arrangement.

FIGS. 10 to 15 show the panels 110, 120, 140, 160, 210, 220, 240, 260 of the kits described above in detail.

Figure 16:
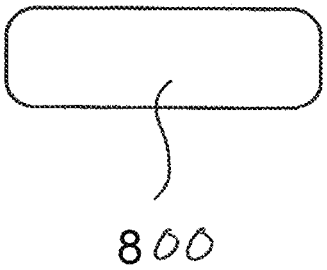
FIG. 16 is a plan view of a locking means for the kits of FIGS. 1, 4 and 8.

FIG. 16 shows an optional locking means 800 which may be inserted into the slots 124, 224 of the upper panel 110 of a unit as described above 101 such that it is supported on the shoulder 150, 248 of the intermediate panel 140, 240 received within that slot 124. The locking means is in the form of a cuboid block of substantially equal dimensions to the interior of the notch 146, 246 of the intermediate panel 140, 240, such that it fills the portion of the slot 124, 224 which is not filled by the outer portion 144, 244 of the intermediate panel 140, 240. As such the intermediate panel 140, 240 is prevented from sliding within the slot 124, 224 and as such is locked within the slot 124, 224 as a consequence of the portion of the first panel 110 received within its notch 146, 246.

Multiple kits 100, 200, 300 may be provided together as a system for constructing a structure such as a shed. For example, such a system may comprise eight kits for constructing L-shaped corner joints such as the kits 100, 300 described with reference to FIGS. 1 to 4 and FIGS. 8 and 9, which in use may define the vertices of a rectangular structure; an additional four kits for constructing T-shaped joints such as the kit 200 described with reference to FIGS. 5 to 7 could be provided so as to extend the structure.

Such systems may further comprise ridge supports 400, joist hangers 420 and/or rafter hangers 440. Examples of such additional components are shown in FIGS. 17 and 18.

Figure 17:
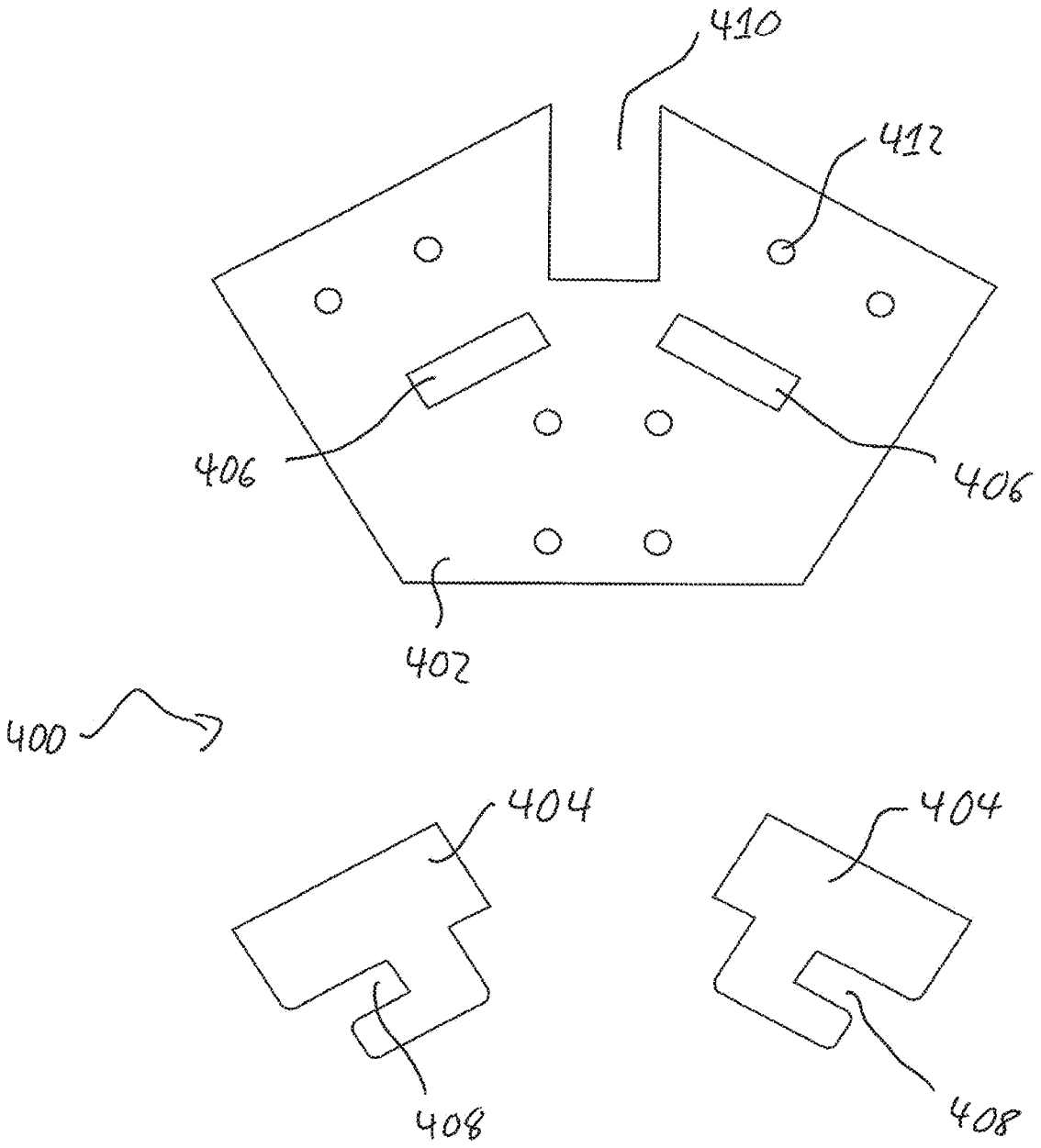
FIG. 17 is an overall view of a ridge support for use with kits according to the present invention.

FIG. 17 shows a multi-panel ridge support comprising a primary panel 402 which is arranged vertically in use and two secondary panels 404 which are received in slots 406 in the primary panel 402. The secondary panels 404 comprise notches 408 defined by L-shaped portions which each receive an edge of the slot 406 receiving them. The secondary panels define a sloped surface orthogonal to the primary panel which supports the upper end of a rafter in use.

The primary panel 402 is substantially pentagonal and comprises an upper notch 410 for receiving and supporting a ridge board. A pair of apertures 412 for bolts are provided adjacent and above each slot 406 for connecting rafters supported by the secondary panels 404 to the primary panel 402. Four further apertures 412 are formed through the primary panel below the notch 410 for connecting to a column post or stud in use.

Figure 18:
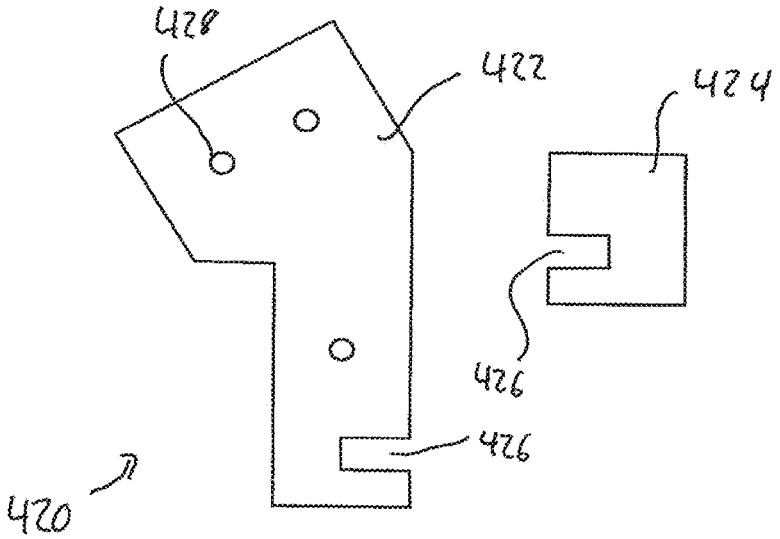
FIG. 18 is an overall view of a rafter hanger for use with kits according to the present invention.
Figure 19:
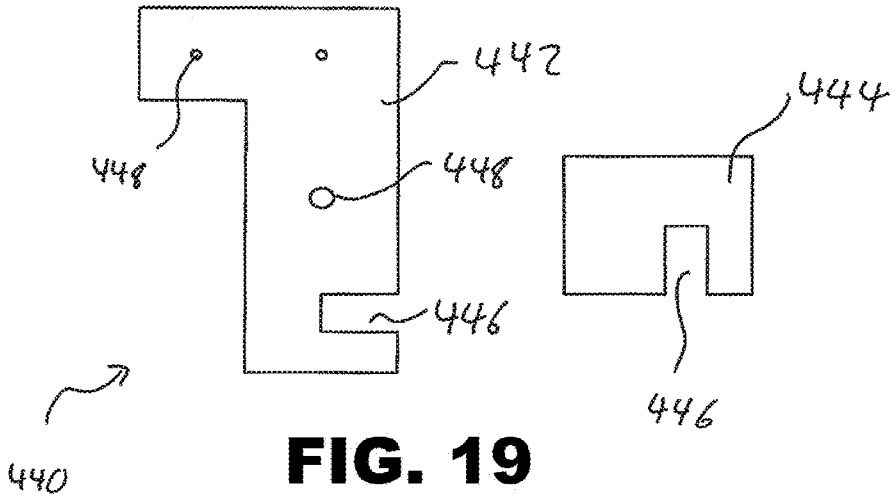
FIG. 19 is an overall view of a joist hanger for use with kits according to the present invention.

FIG. 18 shows a multi-panel joist hanger 420 and FIG. 19 shows a multi-panel rafter hanger 440. The joist hanger 420 and rafter hanger 440 each comprising a primary vertical panel 422, 442 and a secondary horizontal panel 424, 444. The primary vertical and secondary horizontal panels 422, 424, 442, 444 each comprising a notch 426, 446 which defines a halved joint with the notch 426, 446 of the other panel in use. The vertical panels 422, 442 having apertures 428, 448 formed therethrough for connecting to other structural elements.

Throughout the detailed description the terms upper lower, above and below have been used to describe the relative locations of the components of the kits 100, 200, 300 and units 101, 201, 301. It will be appreciated that the kits 100, 200, 300 and units 101, 201, 301 may be reoriented or used at other angles without departing from the scope of the invention.

Any variations of timber depth can be provided for. In practice, European timber sizes are standard throughout the region and many other parts of the world. In the United States the timber sizes differ from European sizes, but are standard throughout the United States.

The invention has been described by way of example only and it will be appreciated that variation may be made to the above described embodiments without departing from the scope of the invention as defined by the claims.

The invention claimed is:

1. A structural joint, in a building frame, made from a kit, defining one or more recesses in said joint, said recesses configured to accept and attach to structural elements of said frame when portions of the structural elements of the frame are placed within the recesses and attached to said joint, the kit comprising:

first and second panels for respectively defining first and second faces of the one or more recesses between the first and second panels in use;

one or more intermediate panels, each defining an intermediate face extending between the first and second faces of at least one of the one or more recesses in use;

one or more pairs of first and second slots, wherein each slot is contained completely within and extending through each of the first and second panels respectively, configured to receive one of the one or more intermediate panels in use;

wherein, each of the one or more intermediate panels comprises first and second notches configured to receive edges of the first and second pair of slots respectively in use, and further comprising locking means located between an edge of a slot and a respective notch, for securing edges of the first and/or second slots within the first and/or second notches, so as to form an interlocked configuration of the first and second and intermediate panels;

a support panel for connecting the first and second panels as a unit to one or more external structural elements outside of the one or more recesses and wherein the first and second panels each comprise a notch for receiving a portion of the support panel in use; and, wherein, the interlocked panels define the one or more recesses having said first and second faces within the joint, and which recesses are configured to receive and attach structural elements of the frame.

2. A kit according to claim 1 wherein the first, second and intermediate panels are substantially flat.

3. A kit according to claim 1 wherein the first and second panels are identically shaped.

4. A kit according to claim 1 wherein the arrangement of first slots through the first panel is identical to the arrangement of second slots through the second panel.

5. A kit according to claim 1 wherein the first and second slots are substantially rectangular.

6. A kit according to claim 5 wherein the width of each of the rectangular first and second slots is equal to the thickness of each of the intermediate panels.

7. A kit according to claim 1 wherein the first and second notches are substantially rectangular.

8. A kit according to claim 7 wherein the width of each of the rectangular first and second notches is equal to the thickness of each of the first and second panels.

9. A kit according to claim 1 wherein the one or more intermediate panels is a plurality of intermediate panels.

10. A kit according to claim 1 wherein there is a plurality of pairs of first and second slots through each of the first and second panels.

11. A kit according to claim 1 wherein the first and second notches in each of the one or more intermediate panels are defined by generally L-shaped extensions from a square or rectangular portion of the intermediate panel.

12. A kit according to claim 1 wherein the support panel comprises a notch for receiving a portion of the first panel in use and a notch for receiving a portion of the second panel in use.

13. A kit according to claim 1 wherein the at least one locking means is an element for fitting into one or both of the first and second slots of the first and second panels between the one or more intermediate panel received therein and the edge of the one or both slots opposite the edge of the slot received by the notch of the intermediate panel in use.

14. A kit according to claim 1 wherein the locking means is of equal dimensions to one of the first and second notches.

15. A kit according to claim 1 formed from engineered timber, steel, concrete, glass reinforced plastic, plastic, carbon fibre, and/or carbon fibre augmented materials.

16. A unit constructed from a kit according to claim 1 which defines one or more recesses.

17. A system comprising a plurality of kits according to claim 1.

18. A corner unit joint within a structure made from structural elements, the unit comprising:

first and second L-shaped corner frame elements defining at least two limbs, each limb having at least one aperture contained completely within said limb, each aperture being dimensioned and configured to receive a stave whereby staves locate in corresponding apertures to connect the respective limbs, and include locking means located between an edge of an aperture and a respective stave, for securing edges of the apertures against said stave, and thereby maintain the frame elements parallel to each other such that outer edges of the frame elements define planes which in use are parallel to walls of the structure, wherein respective opposed faces of the frame elements and a face of at least one of the staves connected therebetween, form three sided recesses configured to receive and attach structural elements of the structure within the recesses.

* * * * *